US006221569B1

(12) United States Patent
Ishikawa

(10) Patent No.: US 6,221,569 B1
(45) Date of Patent: Apr. 24, 2001

(54) METHOD OF FORMING COLOR IMAGES AND PICTURE-TAKING COLOR PHOTOGRAPHIC MATERIAL USED THEREIN

(75) Inventor: Takatoshi Ishikawa, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 54 days.

(21) Appl. No.: 09/128,420

(22) Filed: Aug. 4, 1998

(30) Foreign Application Priority Data

Aug. 5, 1997 (JP) ..... 9-210782

(51) Int. Cl.[7] ..... G03C 7/407
(52) U.S. Cl. ..... 430/359; 430/503
(58) Field of Search ..... 430/359, 505, 430/503

(56) References Cited

U.S. PATENT DOCUMENTS 5,840,470 * 11/1998 Bohan et al. ..... 430/359

OTHER PUBLICATIONS

U.S. application No. 09/076,074, filed May 12, 1998.

U.S. application No. 09/123418, filed Jul. 23, 1998.

* cited by examiner

*Primary Examiner*—Janet Baxter
*Assistant Examiner*—Amanda C. Walke
(74) *Attorney, Agent, or Firm*—Sughrue, Mion, Zinn, Macpeak & Seas, PLLC

(57) ABSTRACT

There are provided a method of forming color images, wherein the image information recorded in a color negative film, which is constituted so as to provide an optical density of not higher than 0.50 in the non-image area in each of densitometric measurements using red light, green light and blue light respectively after exposure and development processing operation, is read photoelectrically, the read image information is converted into electric digital image information, the converted image information is subjected to picture processing and then the processed image information is transmitted to a printer, thereby reproducing color positive images; and a color negative film having the density specified above in the non-image area.

9 Claims, 11 Drawing Sheets

METHOD OF FORMING COLOR IMAGES AND PICTURE-TAKING COLOR PHOTOGRAPHIC MATERIAL USED THEREIN

FIELD OF THE INVENTION

The present invention relates to a method of color image formation wherein the printed color images are obtained from taking in the picture information, which can be gotten by processing the picture-taking color photographic material after exposing (especially a color negative film) used therein.

More particularly, the invention is focused on the method of color image formation wherein the picture-taking images in a color photographic material which are obtained by processing is changed to digital picture information and then printed on a printing material such as a color photographic paper, and it is also focused on a picture-taking color photographic material suitable for such a color image formation method.

BACKGROUND OF THE INVENTION

The most prevailing form of color photography is the so-called nega/paper system (hereinafter referred to as "N/P system"), that is, a system of obtaining color prints by taking pictures with color negative films, and after processing the films, printing the images of the processed film on photographic papers in a photofinishing laboratory. This system has gained international popularity, and has become firmly established in the current market because it can offer convenience and various careful services to customers.

In this system, color prints have been obtained by subjecting a color negative film to conventional processing, printing the image obtained in each frame on a positive material, such as color paper, by giving thereto uniform exposure in accordance with a printing process called non-scanning area-wise exposure, and then performing development.

In recent years, on the other hand, the images of a color negative film have been used in various ways. For instance, such images are photoelectrically read with a scanner to convert the image information into electric signals, subjected to proper picture processing, and then printed or exposed to other image media. According to our analysis, however, the photographic characteristics of current color negative films are not always adapted for new systems of image utilization which involve digital picture processing, because those films are designed for the foregoing non-scanning area-wise exposure system.

The most remarkable inadequacy is attributable to the difference in influence of mask density. The current color negative films are designed so as to have high mask densities, so that the density of the non-image part (hereinafter referred to as "Dmin") is high. Since the gradation part is on the non-image part, the density value in the high density portion approaches to 4. In the system which comprises reading image information with a scanner and applying some picture processing to the read information, too high density value of the high exposure portion in the image part results in a lowering of the reading accuracy of an image density reading device, so that the readable density has its limits.

In the case of high mask density, therefore, the difference between the readable highest density and Dmin becomes small, and thereby the range of exposure amounts to reproduce the gradation in a color positive material, namely a photographic latitude (which is synonymous with "a dynamic range"), is lessened. In the conventional system which requires no picture processing, it is necessary to make corrections on the side absorptions of color-developed dyes by sufficient masking in order to ensure a satisfactory level of saturation to the images reproduced in a color positive material. When the non-scanning area-wise exposure system is adopted for printing, the extension of a printing time can cope with a high density portion because of high exposure in color negative film, so that the conventional system is not severely restricted by the raise in density due to masking. Further, the inventor of the present invention has found that the saturation can be heightened electrically by performing digital picture processing; as a result, it becomes unnecessary to raise the mask density for masking.

The term "density" as used herein stands for photographic density, which is synonymous with optical density. Thus, the term "density" used in the present invention refers to the density generally used by one skilled in the arts.

Additionally, a supplementary explanation is made below as to the terms masking used in connection with color negative films: The magenta dyes formed by color development in color negative films have side absorption in the neighborhood of 440 nm in addition to spectral absorption at essentially required wavelengths, namely in the vicinity of 550 nm. This side absorption is responsible for a drop in the saturation of color print images. As a measure against such a saturation drop, a magenta coupler having such a coupling release group as to absorb light in the spectral region of the side absorption (a colored group containing an arylazo group), namely a coupler with mask-function, is incorporated in a color negative film. The coupler with mask-function is designed so as to adjust the balance between a density raise caused by the side absorption of the magenta dye formed upon color development in the vicinity of 420 to 440 nm and a density drop resulting from a decrease of light absorption in the same spectral region due to the elimination of the foregoing coupling release group from the magenta coupler, thereby masking the color turbidity arising from the side absorption. The term masking refers to the compensation mechanism mentioned above. Accordingly, the masking is essential to the conventional N/P system.

Reduction in photographic latitude (dynamic range) is attributable to other causes besides the high mask density. In particular, the reduction tends to occur when the quality of development processing is lowered by variations in processing steps and some other causes. For instance, stains (Dmin) increased by color contamination (due to insufficiency in washing out spectral sensitizers and antihalation dyes) and bleach fog (undesirable dye stain generated by the oxidative action of a bleaching agent) cause the photographic latitude reduction problem.

On the other hand, desilvering inadequacy is liable to occur when development processing is carried out under an unsuited condition resulting, e.g., from variations in processing steps. In such a case, the quantity of silver residue is especially large in high exposure section, so that the high density areas have a further heightened density. The reading accuracy on the high density side deteriorates when the density value is increased beyond 3.5. This error in reading accuracy is reflected in the highlight areas of a print to exert a bad influence on the important part of printed image qualities. Accordingly, it is necessary to have a high maximum density (Dmax) on the characteristic curve from the viewpoint of improving the image quality, but in the case of too high Dmax the image deterioration factor will function due to unsatisfactory reading accuracy. Thus, it is desirable that Dmax be lowered to the level on which reliable reading become possible as far as the exposure range is within the photographic latitude and still the information recorded in a color negative film can be read exactly.

Additionally, the term "maximum density" is used in two senses, namely "maximum density" as the maintenance limit of accuracy in reading densities and "maximum density" on the characteristic curve of a color negative film. In places where fears are entertained that some confusion will arise, the former is referred to as "(reading) limit density" and the latter is referred to as "Dmax". Making additional remark, most of color negative films have a long gradation range, and so they have indefinite Dmax in contrast to other photographic materials. Thus, Dmax used for a color negative film is intended to describe the density in the upper limit region of the characteristic curve.

As mentioned above, color negative films designed on the assumption that the images formed therein are printed on positive materials by directly undergoing the non-scanning area-wise exposure system do not necessarily have most appropriate designs for the system where the image information is read by a scanner, digitized and then transmitted to various kinds of printing materials and other media; therefore, in the application to such a system, they generally develop defects that the photographic latitude is lessened by their high Dmin and the resultant high image density in high exposure section and the image quality deteriorates due to faults in reading over negative image information. Thus, it has been expected to develop an image formation method which can solve the aforementioned problems confronting the use of digital picture processing.

SUMMARY OF THE INVENTION

The subject of the present invention is therefore to solve the aforementioned problems confronting the image formation method which comprises reading the image of a color negative film with a scanner, converting the read image information into electric signals, subjecting the electric signals to proper picture processing and then printing the processed image or transmitting it to another image medium. More specifically, objects of the present invention are to provide the color image formation method with which a positive image of high quality having the elevated picture-taking latitude and the improved gradation in highlight areas is obtained by subjecting images of color negative film to the picture processing, and to provide a color negative film suitable for the aforesaid color image formation method.

In consideration of the foregoing objects, the inventor of the present invention has made intensive studies on the necessary conditions to be fulfilled by picture-taking materials adaptable for digital picture processing of developed images, thereby achieving the present invention. More specifically, the objects of present invention are attained by the following embodiments:

1. A method of forming color images, wherein an exposed color photographic material is subjected to development processing and the image information obtained therefrom is transmitted to a printer; (1) with the color photographic material providing an optical density of not higher than 0.50 in the non-image area after the development processing in each of densitometric measurements using red light, green light and blue light respectively, and (2) (a) with the image information recorded in said color photographic material being read photoelectrically, (b) the read image information being converted into electric digital image information, (c) the converted image information being subjected to picture processing and then (d) the processed image information being transmitted to a printer.

2. The method of forming color images according to the foregoing embodiment 1, wherein the color photographic material has a gradient between 0.20 and 0.60 after the development processing.

3. The method of forming color images according to the foregoing embodiment 1 or 2, wherein the printer is loaded with silver halide color photographic paper.

4. The method of forming color images according to the foregoing embodiment 1, 2 or 3, wherein the development processing is a rapid processing and requires 30 to 210 seconds for covering the period from the completion of the color developing step to the beginning of the drying step via desilvering, washing and image stabilization steps.

5. A picture-taking color photographic material used in a method of forming color images wherein an exposed color photographic material is subjected to development processing and the image information thus recorded therein is read photoelectrically, the read image information is converted into electric digital image information, the converted image information is subjected to picture processing and then the processed image information is transmitted to a printer; with the color photographic material providing an optical density of not higher than 0.50 in the non-image area in each of densitometric measurements using red light, green light and blue light respectively and having a gradient between 0.20 and 0.60 in image areas after the development processing.

DETAILED DESCRIPTION OF THE INVENTION

Figure 1:
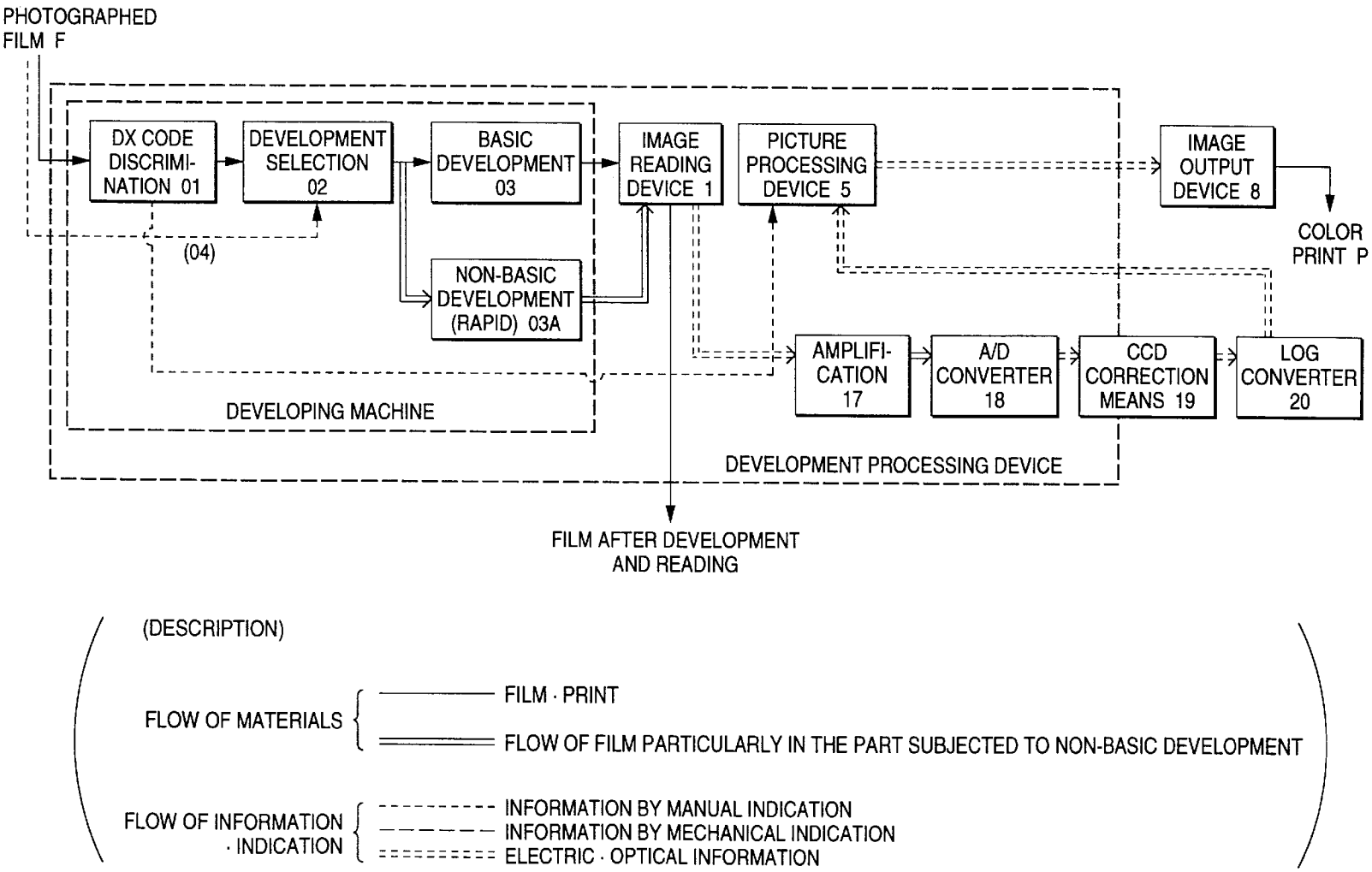
FIG. 1 is a block diagram illustrating the basic constitution and the general flow of an image formation method and a device relating to the present invention.

The present invention relates to a color image formation method, the main gist of which consists in digitizing the images obtained by picture-taking and subsequent development processing and then subjecting the digitized images to picture processing, and to a color photographic material used in such a color image formation method. The most suitable color photographic materials for the present invention are color negative films. In the following description, therefore, the present invention is illustrated mainly by embodiments using color negative films.

The present invention, as described above, relates to a method which comprises subjecting a color negative film after picture-taking to development processing and transmitting the image information obtained therefrom to a printer; being characterized in that (1) the color negative film used therein provides an optical density of not higher than 0.50 in the non-image area after the development processing in each of densitometric measurements using red light, green light and blue light respectively and (2) (a) the image information recorded in the color negative film is read photoelectrically, (b) the read image information is converted into electric digital image information, (c) the converted image information is subjected to picture processing and then (d) the processed image information is transmitted to a printer. Thus, these essential constituent factors of the present invention are illustrated individually in detail.

First, the designs for color negative films usable in the present invention, wherein the densities in non-image areas are reduced, are described. Conventional color negative films, as mentioned above, are designed using a masking technique so as to provide in non-image areas optical densities of 0.2–0.3, 0.7–0.8 and 0.9–1.0 in the densitometric measurements using red light, green light and blue light respectively; as a result, in the image areas, the mask densities are reduced in quantities balancing with the side absorptions of the formed dyes. Namely, compensation for densities arising from the side absorptions is made to achieve excellent color reproduction. On the other hand, one of the essential constituent factors of the present invention consists in designing a color negative film so as to provide in the non-image area an optical density of not higher than 0.5, preferably not higher than 0.3, particularly preferably from 0.1 to 0.2, in each of densitometric measurements using red light, green light and blue light respectively. This design enables the extension of a readable density range to secure a satisfactory level of photographic latitude.

The reduction of optical densities in the non-image area of a color negative film can be effected by lowering the extent of masking, or decreasing the amounts of couplers with mask-function added. In the extreme case where any couplers with mask-function are not added, the particularly preferred density range 0.1–0.2 can be achieved in the non-image area. Of course, the lowering of the mask level is attended by a drop in the saturation of color images, an increase in color mixing and a decrease in color reproducibility. In the present invention, the removal of these drawbacks is accomplished by carrying out picture processing after reading the image information, so that the amounts of couplers with mask-function added can be reduced to an extreme extent.

The following is fundamentals of a process to prevent the color reproducibility from lowering due to reduction of couplers with mask-function in amounts added or disuse thereof by performing picture processing: The image information recorded in the developed color negative film is read photoelectrically and converted into electric digital image information, and the digitized image information undergoes correction to the side absorptions of image dyes at the time of picture processing. In the case of a magenta colored coupler, for instance, the picture processing in a picture processing device shown hereinafter (denoted by the numeral 5 in the block diagram of FIG. 2) is performed in the direction of deletion of the density arising from the side absorption component in the spectral region of blue light (i.e., the light absorption region of a yellow dye) which corresponds to the dye density in the color developed part of the magenta dye. As a result, only the contribution of a yellow dye to the density measured using blue light is substantially reflected in the image density. Detailed explanation of this mechanism will be added in picture processing device.

Besides the mask density, densities attributable to spectral sensitizers remaining in a film without being washed out, dyes added for the prevention of irradiation, as filters or for other purposes, and colored processing agents and the reaction products thereof which still remain in a film after washing contribute to the density in non-image areas. In color negative films, however, the mask density constitutes a major contribution to the density in non-image areas, so that the reduction of couplers with mask-function in amounts added or no addition of couplers with mask-function can achieve a great effect.

In the next place, the soft gradation which is one of factors characterizing the design of a color negative film according to the present invention is illustrated below. The effects of the present invention can be further enhanced by conferring soft gradation on a color negative film which is designed so as to have a reduced density in non-image areas.

Figure 11:
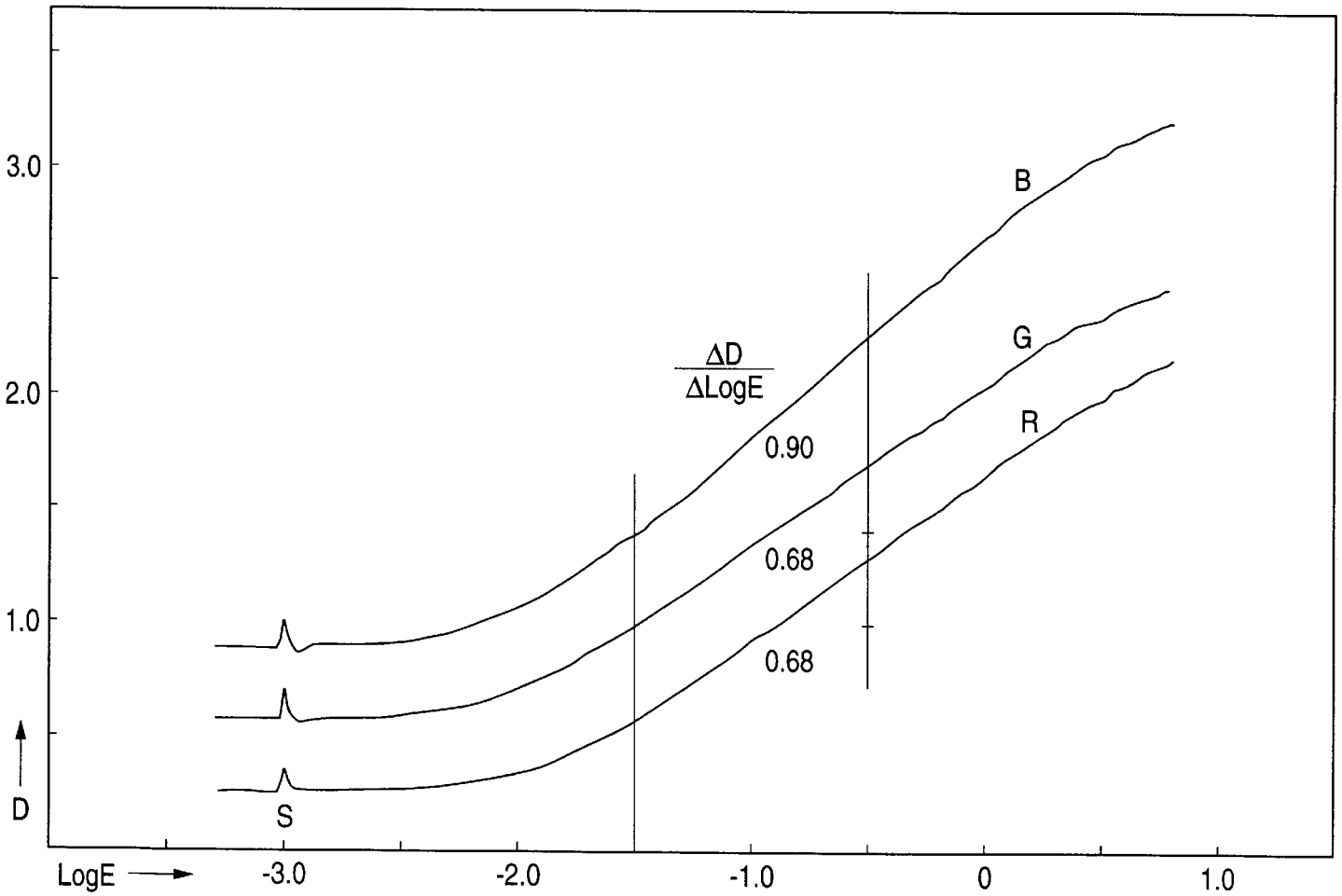
FIG. 11 shows standard characteristic curves of a color negative film drawn for explanation of the objects and the effects of the present invention.

FIG. 11 shows characteristic curves obtained by subjecting a standard color negative film to the exposure using a standard light source defined by the international standard of sensitivity determination of color negative films (ISO 5800) via an optical wedge of spectrally neutral carbon (density gradient: 0.8/cm), and then to development processing substantially common in the world [e.g., C41 system (specified by Eastman Kodak Co.), CN16 system (specified by Fuji Photo Film Co., Ltd.) and CNK4 (specified by Konica Co.), which correspond to the development processing defined in the above international standard]. As shown in this figure, general gradation is from 0.6 to 0.9, expressed in the terms of gamma value ($\Delta D/\Delta \log E$). In the present invention, on the other hand, the gamma value is from 0.20 to 0.50, preferably from 0.25 to 0.45. Namely, a color negative film according to the present invention has a gamma value reduced to about one-half those of color negative films which are on the market today. By designing a color negative film so as to have such a soft gradation, the present invention can fully achieve its effects.

The exposure range which goes up to the point corresponding to the density 3.5, that is a limit density of reading, namely a photographic latitude, is considerably extended by reduction in gradation. The reason for this extension is explained below by an example. In FIG. 11, the yellow characteristic curve of a blue-sensitive layer still has a gradient at the point 3.5 as the reading accuracy limit, and so it is understandable that the photographic latitude (=reproduction latitude) is restricted from the reading ability rather than the shortness of the characteristic curve. In a case where development processing fluctuates in conditions, especially desilvering inadequacy occurs, the influence of such a restriction is easily supposed to become great. If the gamma value of this yellow characteristic curve is lowered to 0.70 by 30% reduction, the readable exposure range in the high exposure region is increased by 0.5 in terms of logarithmic exposure amount (the number on the abscissa) and, in other words, the resultant film becomes unaffected by overexposure to an extent of 1 or 2 on the stop scale.

Examples of a means to lower the gamma value include (1) conferring soft gradation upon a light-sensitive emulsion itself, (2) reducing the amounts of couplers with mask-function, DIR couplers, dye forming couplers and silver halides coated on a film, and (3) combining (1) and (2). Of these means, the means (1) is desirable from the viewpoint of image quality, because it slightly, if ever, reduce the amount of image information.

As for the means (2) to lower the gamma value, it is preferable to reduce the amount of silver halide coated on a film. Embodiments wherein, though couplers with mask-function are not added at all or added in reduced amounts, other couplers are not reduced in amounts added are also included in the scope of the present invention. In such embodiments, the amount of silver halide used can be reduced by the amount balancing with that of silver halide required for the coupling reaction with couplers with mask-function. However, the low gamma values specified above cannot be attained only by such a reduction in the amount of silver halide. In further embodiments of the present invention, therefore, DIR couplers are also reduced in amounts added or they are not added at all; as a result, the amount of silver halide used can be decreased by the amount balancing with the reduction of DIR couplers in the amounts added. In color negative films, DIR couplers have functions of raising color saturation through the interimage effect, improving the image sharpness by strengthening the fringe effect and fining down silver halide grains by inhibiting the development. Accordingly, simple disuse of DIR couplers results in the lowering of color reproducibility, color saturation, sharpness and graininess. The present invention solves this problem by introducing a certain processing for correcting those defects into a picture processing system. More specifically, in order to deal with the defects of a color reproducibility drop and a color saturation drop, similarly to the above, a picture processing operation is performed wherein a minus correction of the magnitude corresponding to the density of one dye in a high density range is applied to the densities of the other two dyes. In order to deal with the defects of a sharpness drop and a graininess drop, on the other hand, an operational unit for improving the image sharpness and an operational unit for improving the graininess are incorporated into a picture processing device. Thus the loss in effects of DIR couplers can be corrected. The mechanisms for these corrections will be further explained hereinafter.

It is preferable to further lower the gamma value by the reduction of silver halide in the amount used through no addition of couplers with mask-function and DIR couplers or addition thereof in reduced amounts. For this purpose, principal couplers, or cyan, magenta and yellow couplers, are desirably reduced in the amounts used to decrease the coverage rate of silver halide by the quantity balancing with the reduced amounts of principal couplers. In general, the reduction in the coverage rate of silver halide causes a decrease of image information. However, it has been found that substantial influence of the decrease in image information upon image quality can be avoided by combining the reduction in silver halide coverage with picture processing as far as the extent of reduction in silver halide coverage is within some definite range. As a reason for this avoidance, it can be assumed that, if only there is a minimum of recorded information, the information is probably stressed through picture processing, so that redundancy of the image information recorded in a color negative film becomes wide.

By use of an emulsion with low gradation as described above, or by reduction of couplers and silver halide in the amounts used, it is desirable to design a soft negative film having a sufficient level of photographic latitude for image-reading, specifically a negative film having a gamma value within the range of 0.2 to 0.5, preferably 0.25 to 0.45, in a red-sensitive layer (cyan), within the range of 0.2 to 0.5, preferably 0.25 to 0.45, in a green-sensitive layer (magenta) and within the range of 0.2 to 0.6, preferably 0.25 to 0.5, in a blue-sensitive layer (yellow), namely a gamma value about one-half the gamma values of color negative films on the market today which are suitable for the system where the output of their image information is made as color prints by means of non-scanning area-wise exposure without undergoing any picture processing.

Owing to the reduction of couplers with mask-function, DIR couplers and principal couplers in the amounts used, as mentioned above, the coverage rate of silver halide can be reduced; as a result, a color negative film relating to the present invention can have a coverage rate of 0.5 to 6.0 $g/m^2$, preferably 1.0 to 5.0 $g/m^2$, particularly 2.0 to 4.0 $g/m^2$, based on silver. This saving in an amount of silver used is not a purpose of the present invention, but a result.

When both non-image area density and gamma value are lowered, Dmax is also lowered. It is desirable for Dmax to be from 1.5 to 3.5, preferably from 2.0 to 3.0.

With respect to the speeding-up of development processing for color negative films according to the present invention, the processing operations after the completion of color development may be speeded up. It is nearly common in the world that the standard color development of color negative films is carried out at 38° C. for 195 seconds. In the present invention also, the color-development processing is carried out under the standard condition. After the completion of this processing, however, a measure of rapid processing can be adopted wherein the period from the end of a color development step to the beginning of a drying step, going through desilvering, washing (and rinsing) and stabilization steps, is shortened to be from 30 to 210 seconds. It is desirable that the time required for a bleaching step be from 10 to 120 seconds, that for a fixing step be from 10 to 120 seconds, that for a washing (and rinsing) step be from 5 to 60 seconds, that for a stabilizing step be from 5 to 60 seconds and the total time required for these four steps is 210 seconds or less. Preferably, the bleach time is from 10 to 60 seconds, the fixation time is from 10 to 60 seconds, the washing (and rinsing) time is from 5 to 60 seconds, the stabilization time is from 5 to 60 seconds, and the total time for these four steps is 210 seconds or less. Particularly preferably, each processing step is completed within the above-described period of time and the total time required for the four steps is 150 seconds.

As the color negative films having low Dmin and low gamma values according to the present invention allow some latitude in the image reading limits, variations caused in Dmin and gamma values by the foregoing rapid processing after the completion of color development, which are attributable for desilvering inadequacy and insufficiency in washing out spectral sensitizers and other dyes, can be compensated by picture processing. Thus, the great speeding-up of development processing as mentioned above becomes possible in the present invention.

In a case where a color negative film do not need to be preserved after the image information therein is read, the minimum requirement for the film is to be desilvered and washed to the extent of enabling the reading of image information. Since (1) the processing rate in each of bleaching and fixing steps is very high in the initial stage after the film is soaked in the processing solution and (2) color negative films relating to the present invention are essentially low in processing load and designed to be suitable for rapid processing, it is possible in the most rapid processing case to finish each of bleaching and fixing steps in 10 seconds and to finish each of washing and stabilizing steps in 5 seconds.

Also, the desilvering step may be a bleach-fix processing step instead of being constituted of a bleaching step and a fixing step. A suitable time for bleach-fix processing is longer than each processing time for the separate steps and shorter than the total processing time therefor.

In performing rapid development processing operations, the development processing apparatus used may be a developing machine of rapid processing type wherein a standard color-development step can be incorporated, or a developing machine wherein the switch in development processing from a standard type to a rapid type or vice versa can be made by changing the transporting speed.

As mentioned above, color negative films applicable to the image formation method of the present invention are low contrast negative films having a mask density reduced to 0.5 at the highest and the maximum density of the order of 2.5 in the image areas, and the reduction in the coverage rate of silver halide can newly impart thereto the advantages illustrated above.

In the present invention, the image information taken out from the development-processed color negative film is a digitized image information, a printer into which the digital image information can be fed is any positive image output device into which the digital information can be fed, and the digital image information is taken out on color printing materials with which the device is provided.

Examples of a color positive material suitable for such a purpose include silver salt photographic materials, such as silver salt color photographic paper, a color diffusion transfer material (namely color instant photograph) and a heat-developable color diffusion transfer material (e.g., "Pictrography", commercial name, a product of Fuji Photo Film Co., Ltd.), and non-silver photographic materials such as an ink jet recording material, a sublimation type heat-sensitive dye transfer recording material, a heat-developable multilayer diazo color (e.g., "Thermoautochrome", commercial name, a product of Fuji Photo Film Co., Ltd.). Of these materials, silver salt color paper is preferred over the others.

Now that the gist of the present invention and the constituent elements of a color negative film used in the present invention are explained above, next explanation is made as to embodiments of a method of forming positive images in accordance with the present invention, wherein the image information is read in a development-processed color negative film, the read image information is converted into digital image information, the digital image information is subjected to picture processing and then the processed image information is reproduced in a positive material. The explanation is divided under the following five heads, and detailed illustrations are given below on these heads in the order of description.

I. Outline of the flow in a development processing device for carrying out the image formation method of the present invention II. Image reproducing devices 1) Reading image information in a development-processed film 2) Picture processing of read image information 3) Transmitting picture-processed image signals to a printer III. Positive material used for reproduction of image IV. Picture-taking color photographic material (color negative film)

V. Development processing

I. Outline of the flow in a development processing device for carrying out the image formation method of the present invention FIG. 1 shows a development processing and a picture processing device used for the image formation method of the present invention, and a flow of operations performed therein. It is desirable, but not essential, for the development processing device to be equipped with a means of detecting the type of a color negative film after picture-taking to be processed therein (abbreviated as "a film" hereinafter) at the initial stage of processing course. The film is fed into this development processing device on the left side of the diagram shown in FIG. 1, and the type thereof is first read (01). More specifically, the film is detected as to whether it is a film of the type which is suitable for the image formation method of the present invention, namely a film having a low mask density and soft gradation (low gamma value), or a film of conventional type, and then the selection of a processing course or/and the setup of picture processing conditions are made on the basis of the detection result. In the case of using the developing machine disclosed in JP-A-6-51479 (the term "JP-A" as used herein means an "unexamined published Japanese patent application") which has both standard and rapid developing tanks to enable the choice of a tank appropriate for the type of the film, the selection of a processing course after the color development (the choice between rapid development processing described as "non-basic development (03A)" in FIG. 1 and standard development processing described as "basic development (03)" in FIG. 1) is made. Even when the film is a film according to the present invention, standard development processing may be chosen as a matter of course without modifying the development processing course, and a developing machine which can perform standard development processing alone can be used, too.

The conception of the basic development processing and that of the standard development processing are clarified below. The basic development processing refers to a development processing condition for achieving the photographic characteristics (basic characteristics) aimed at by each photofinishing laboratory or the image formation device in which a picture processing mechanism is built. Examples of such a processing condition include the processing conditions of the foregoing development processing system adopted in common in the world (specifically, the processing conditions nearly common in a substantial sense, which each meet the requirements for standard development processing defined by the international standard ISO 5800, such as the C41, CN16 and CNK4 systems recited above (the photographic characteristics attained by these systems are intended to be on a common level, although the makers have some technical difference as a matter of course)). Therefore, the photographic characteristics achieved by the basic development processing can generally be construed as those achieved by the standard development processing substantially common in the world (strictly speaking, users' tastes differ in different nations and different localities, but these differences may be neglected in the present invention).

The picture processing conditions of films relating to the present invention are, in principle, the same as those for conventional films. However, it is desirable that the processing condition setup based on basic characteristic curves built in the picture processing device be chosen depending on the result of detecting the film type, because the films of conventional type are greatly different in Dmin and gradation from the films relating to the present invention.

The detection, or read, of the film type may be made using the so-called DX code marked in the film, or perforated marks for discrimination. Regardless of the DX code, on the other hand, an operator may perform operations for selection in accordance with the prescribed basis (04). However, such detection and selection of conditions may be unnecessary in the case of using an exclusive device wherein only the operations according to the method of the present invention are performed.

The development processing device and the picture processing device used for the image formation method of the present invention (which may be joined into one unit or left as they are separated) may be exclusive ones for the present invention. Also, both the processing of conventional type films and the photographic and picture processing of films of the type for use in the present invention can be performed by use of one device as far as the detection of film type is built therein.

After the development processing conditions are selected (02), the film is transported so as to pass through a series of processing tanks installed in a developing machine. It is desirable to adopt a roller transport system at the developing machine. Also, the developing machine used in the present invention may be a developing machine of the type which enables both standard development processing and rapid development processing after the completion of color development by changing the roller transport speed and choosing a transport path (03 and 03A).

The film which has undergone the development processing constituted of color development, bleach, fixation, washing and stabilization steps is transferred to an image information reading step (1).

In the step of reading image information, the transmission density measurements are made for each of minute-area units (referred to as "pixel") constituting the images in the development-processed film, and thereby the image information is read as a density of every pixel. As a result of the reading, the image information is converted into electric image signals based on the density values, and further converted into digital signals in an A/D (analog/digital) conversion unit 18 via a amplifying device 17. These information signals are corrected for every pixel variations in sensitivity, dark current and so on, namely CCD functional corrections 19 are made on the information signals, and then transmitted to a picture processing device 5 via a log converter 20.

In the picture processing device, electric processing is added to the image information converted into digital signals, and thereby the image information obtained from the film having soft gradation and low Dmin is converted into digital image signals which are expected to be obtained from a negative film having standard gradation and standard Dmin (i.e., characteristics of basic development processing). A feature of the present invention is in that the correction for those deviations in photographic characteristics ascribed to the film and development conditions employed is made by picture processing operations. The picture processing operations adopted herein were applied for patents, separately from the present invention, and the patent applications thereof are pending as Japanese Patent Application Nos. 8-174022 and 8-182551 (which correspond to JP-A-10-020457 and JP-A-9-146247, respectively).

The image signals of the development-processed film after conversion to normal photographic characteristic values are exposed via a printer (8), and thereby a normal positive image is obtained. The printer may be any type of printer as far as electric or photoelectric image signals can be put therein. In particular, printers for positive image formation, such as printers providing color prints, instant photographs, silver salts color prints of heat-developable color diffusion transfer type and so on, ink jet printer, sublimation type heat-sensitive transfer printers and wax type heat transfer printers, are favorably used.

The method of obtaining normal positive images from the photographic images recorded in a low Dmin or soft gradation film according to the present invention and the device used therefor are outlined above. Further, detailed explanation thereof is given below.

The expression "images obtained by the development-processing of the film for use in the present invention are converted so as to have normal photographic characteristic values by picture processing" means that the image information having the same quality as that obtained by standard development processing (or basic development processing characteristics) is obtained by the picture processing. Specifically, whether or not the two pieces of image information are the same in quality is basically judged from the evaluation of photographic images by visual observation. In the case of attaching importance to the objectivity, however, the image density can be used as a characteristic value capable of representing photographic characteristics. More specifically, if the density value is within ±10% of the basic value, it can be said that the image information obtained is equivalent to that obtained by basic development processing. In other words, since the one-key correction in a color printer of non-scanning area-wise exposure system is about 8% and a difference within such a range is generally allowed, an allowable difference between the characteristic value obtained by non-basic development processing and the basic value can be regarded as within 10% on the basic value.

II. Image Reproduction Device (From image information obtained by rapid development processing into images to be obtained by basic development processing)

The process which comprises reading image information in a film which has undergone rapid development processing, digitizing the read information, subjecting the digitized information to picture processing to convert it into image characteristics equivalent to those obtained by basic development processing, and then taking in the characteristic values to a printer for positive image formation is explained under sections 1) to 3). In order to afford a better understanding of the aforesaid process, the image reproduction devices disclosed in JP-A-10-020457 and JP-A-9-146247 is taken as an example of further explanation. However, those devices should not be construed as limiting the scope of the development processing device and image reproduction process usable in the present invention.

Figure 2:
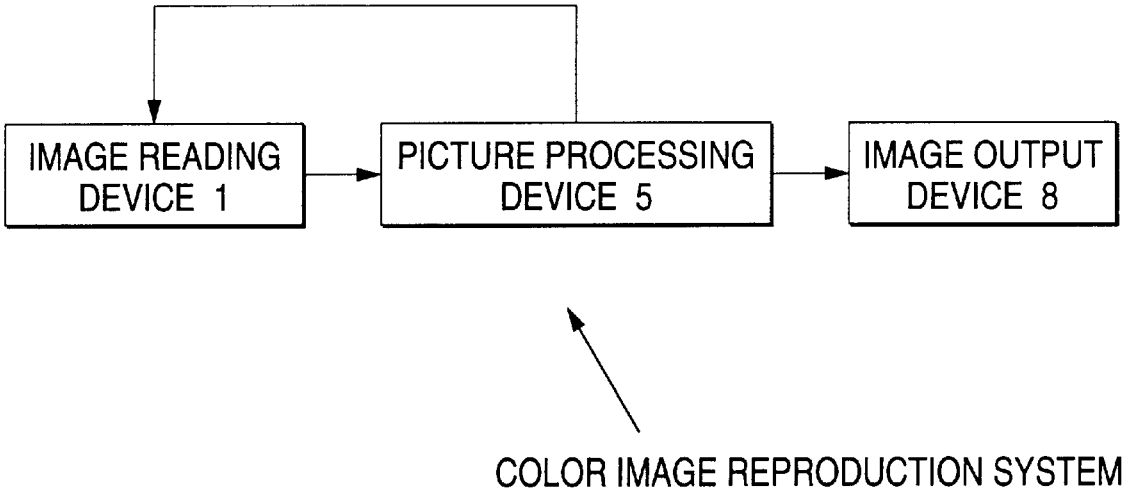
FIG. 2 is a block diagram showing the basic construction of an image reproduction system relating to the present invention.

FIG. 2 is a block diagram showing the basic constitution of an image reproduction system according to the present invention. As shown in FIG. 2, the image reproduction system has an image reading device 1 wherein color images are read and the digitized image data are produced, a picture processing device 5 wherein the image data produced in the image reading device 1 undergo the prescribed picture processing, and an image output device 8 wherein color images are reproduced on the basis of the image data which have received the picture processing in the picture processing device 5.

1) Reading image information in a development-processed film:

Images can be read using any of the following three methods.

(i) A method in which, while the film fastened round a rotating drum is being irradiated with measuring light combined with color separation filters, the rotation of the drum and the side scan in the drum direction are carried out at the same time, and thereby the reflection density of each pixel is read as an amplified electric signal through photoelectric conversion with photomultiplier tubes.

(ii) A line CCD-scan method in which, while performing side scan on the images in a development-processed film by means of a line CCD which has light receiving elements aligned in one dimension, the transmission or reflection density is received on the line CCD and converted to electric signals through electric scan.

(iii) An area CCD method in which pixel densities are read with area CCD as they are in two-dimensional state, and the read densities are converted to electric signals having the time series alignment by subjecting the pixel densities read in the two-dimensional state with the area CCD to electric scanning.

Of these methods, the area CCD method is preferred over the other two. Therefore, the following explanation is made assuming that the area CCD method is adopted. Of course, the present invention can be carried out using the other two method without inconvenience.

Also, a reflection density reading method in which reflection from the image plane of a development-processed film is read may be adopted.

Figure 3:
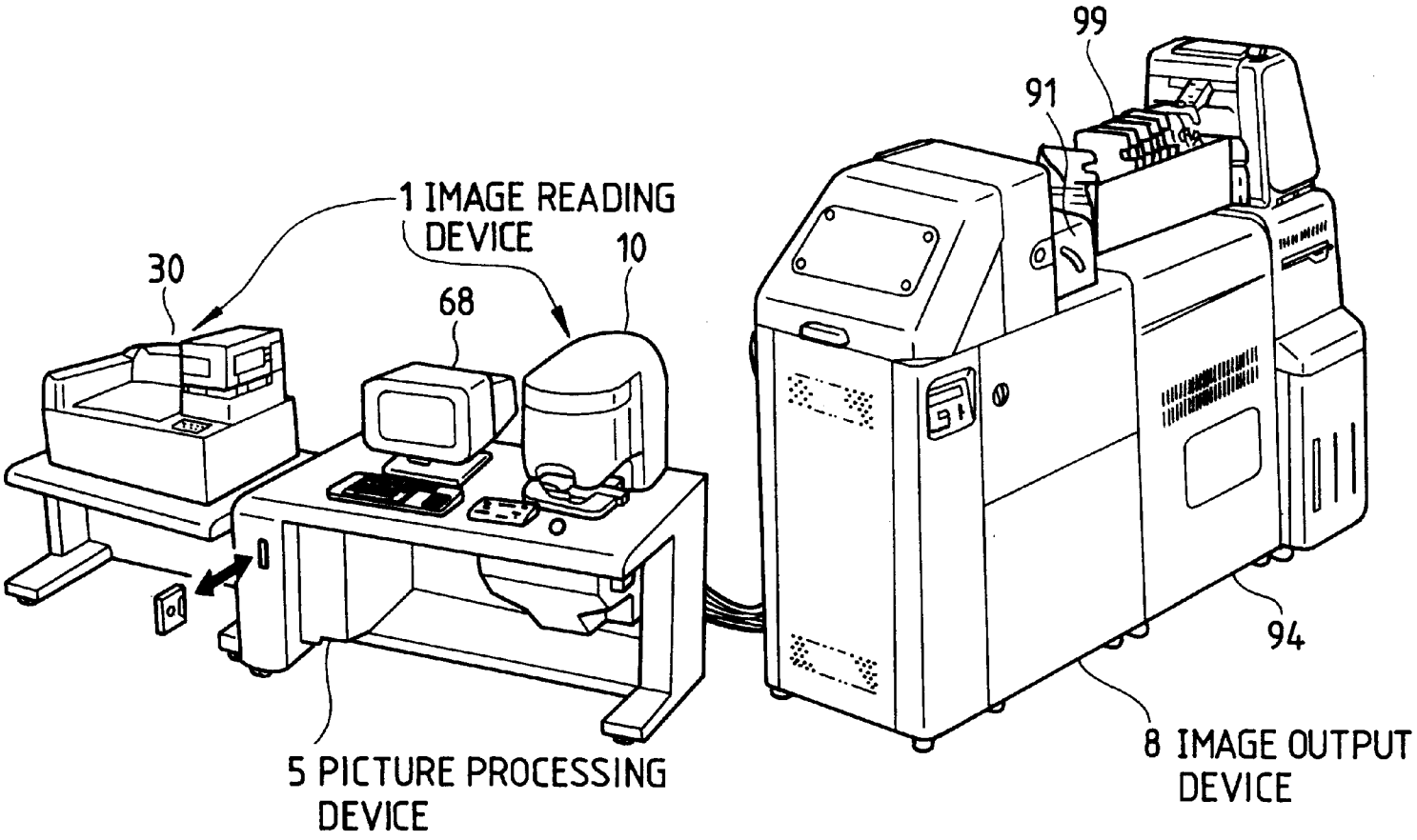
FIG. 3 is an exterior view of one embodiment of an image reproduction system relating to the present invention.

The external view of the image reproduction system shown in FIG. 2 is drawn in FIG. 3. In the actual image reproduction system, as illustrated in FIG. 3, the image reading device 1 is constructed so that either a transmission-type image reading device 10 wherein color images recorded in films are read photoelectrically or a reflection-type image reading device 30 wherein color images recorded in color prints are read photoelectrically is selectively connected to a picture processing device 5, and thereby both color images recorded in films and those recorded in color prints can be reproduced. Herein, however, the explanation is made as to the image reading device for color negative films relating to the present invention.

Figure 4:
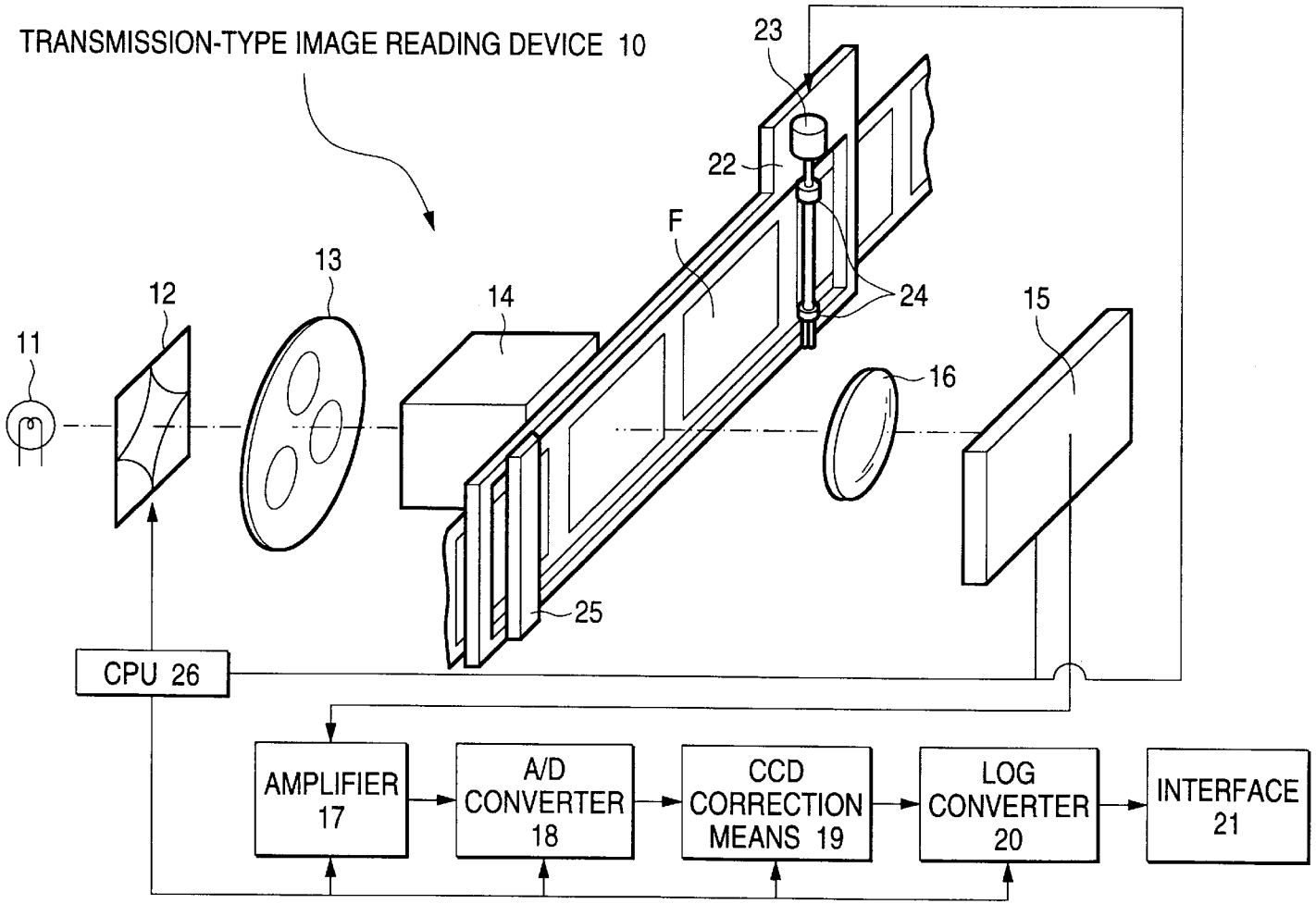
FIG. 4 is a schematic view of a transmission-type image reading device.

FIG. 4 is a schematic view of a transmission-type image reading device 10 used for a color image reproduction system in which image data is produced on the basis of color images. As shown in FIG. 4, the transmission-type image reading device 10 is constituted so as to enable the photoelectric read of color images, wherein the color image recorded in a film F is irradiated with light and the light transmitted by the film is detected. More specifically, the image reading device 10 is provided with a light source 11, a light quantity adjustment unit 12 which can adjust the quantity of light emitted from the light source 11, a color separation unit 13 for separating the light emitted from the light source 11 into three colors, R (red), G (green) and B (blue), a diffusion unit 14 for diffusing light so that the film F is irradiated uniformly with the light emitted from the light source 11, a CCD area sensor 15 for photoelectrically detecting the light transmitted by the film F, and an electromotive zoom lens 16 which enables the light transmitted by the film F to form an image on the CCD area sensor 15. If the exchange of film carriers, which are not shown in FIG. 4, are made, the reading of images in various types of films, such as a negative film in 135 magazines, a positive film in 135 magazines and an advanced photosystem (APS) film, becomes possible by use of this transmission-type image reading device 10.

The light source 11 used actually is a halogen lamp, and the light quantity adjustment unit 12 is designed so that two stop plates are made to move and the quantity of light is changed exponentially with respect to the moving distance thereof. The color separation unit 13 separates light into three colors in succession by revolving a disk having three filters for R, G and B separation. The CCD area sensor 15 has light receiving elements corresponding to 920 pixels by 1380 pixels, and so it enables high resolution reading of the image information in a film. With respect to color images read photoelectrically, the CCD area sensor 15 is constituted so that the image data in the odd-number field consisting of the image information on odd lines and the image data in the even-number field consisting of the image information on even lines are transmitted in succession.

The transmission-type image reading device 10 is further equipped with an amplification 17 for amplifying R, G and B image signals detected photoelectrically and produced by the CCD area sensor 15, an A/D converter 18 for digitizing those image signals, a CCD correction means 19 in which the image signals digitized by the A/D converter 18 are corrected for every pixel variations in sensitivity and dark current, and a log converter 20 in which the R, G and B image data are converted to density data. The log converter 20 is connected to an interface 21.

The film F is held by a carrier 22, the film F held by the carrier 22 is transported to the predetermined position by means of a driving roller 24 moved by a motor 23, kept by a press in a stopped state, and subjected to reading of one frame of color image. After completion of one-frame reading, next one frame of color image is transported to the predetermined position. As an auto carrier to deal with negative films, auto carriers used in conventional minilaboratories, e.g., NC135S made by Fuji Photo Film Co., Ltd., can be used. Images can be read as far as they are within the range corresponding to the printing forms, such as a full size, a panoramic size and a powerful size. In the case of using trimming carriers used in conventional minilaboratories, the about 1.4 times enlargement, taking the center as the axis therefor, becomes possible. Also, the reversal carriers disclosed in JP-A-9-114011, JP-A-9-114016, JP-A-9-114017, JP-A-9-120104 and JP-A-9-130557 can be used.

The image plane detecting sensor 25 detects the density distribution of the color image recorded in a film F, and the density signals detected thereby are transmitted to CPU 26 which controls the transmission-type image reading device 10. On the basis of the density signals, the CPU 26 computes the image plane position of the color image recorded in the film F and, as soon as it judges the image plane position of the color image to reach the predetermined position, it acts so as to stop the drive of the motor 23.

The image reading device may be attached to any place, such as the inlet or outlet of the drying unit of a developing machine, an independent reading/picture processing device or a printer division.

2) Picture processing of the read image information:

As the image reading device 1 shown in FIG. 1 and FIG. 2 is illustrated above in detail, the picture processing device 5 shown also in FIG. 1 and FIG. 2 is then explained.

Figure 5:
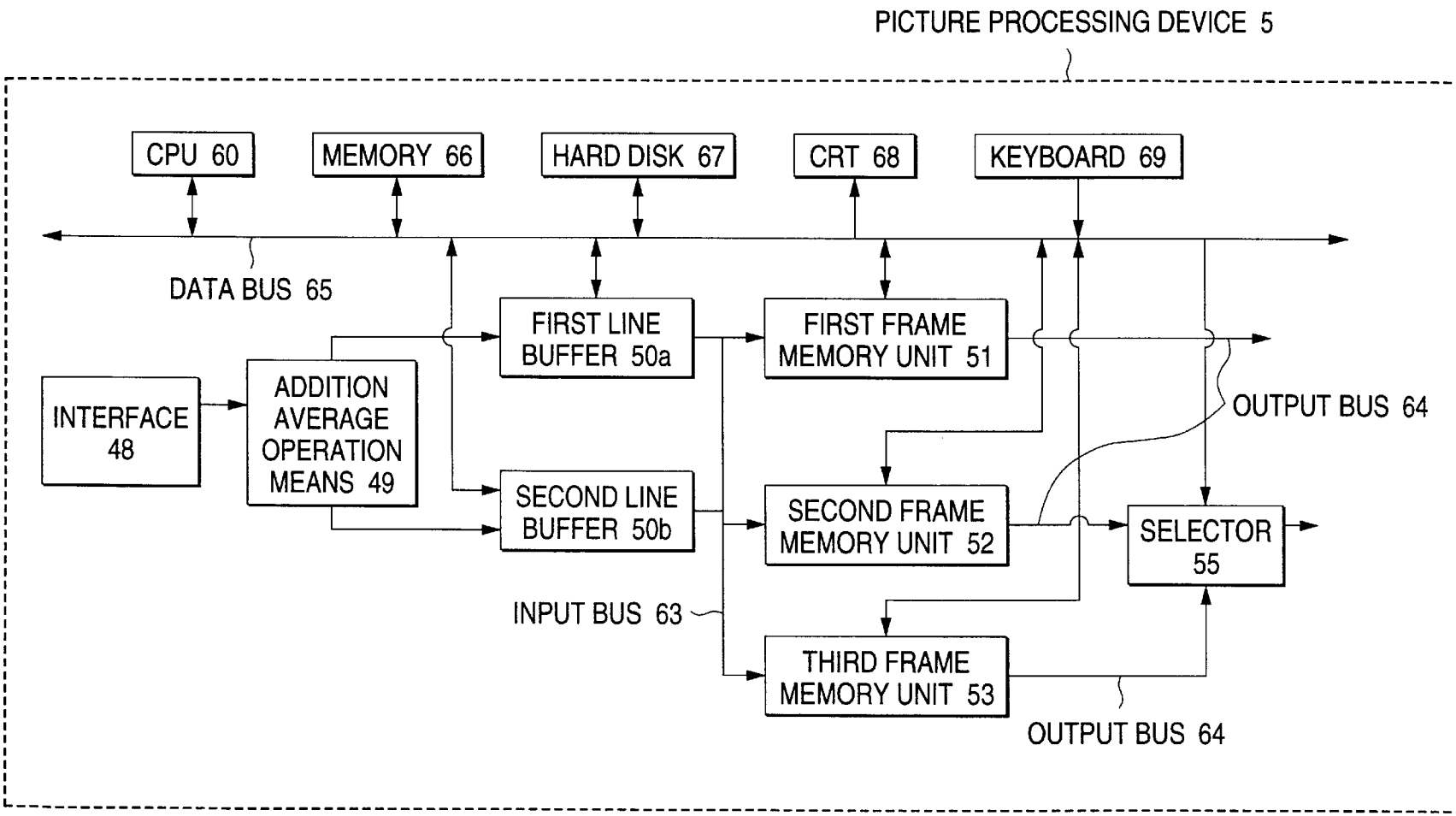
FIG. 5 is a block diagram illustrating a part of the construction of the picture processing device 5 shown in FIG. 2.
Figure 6:
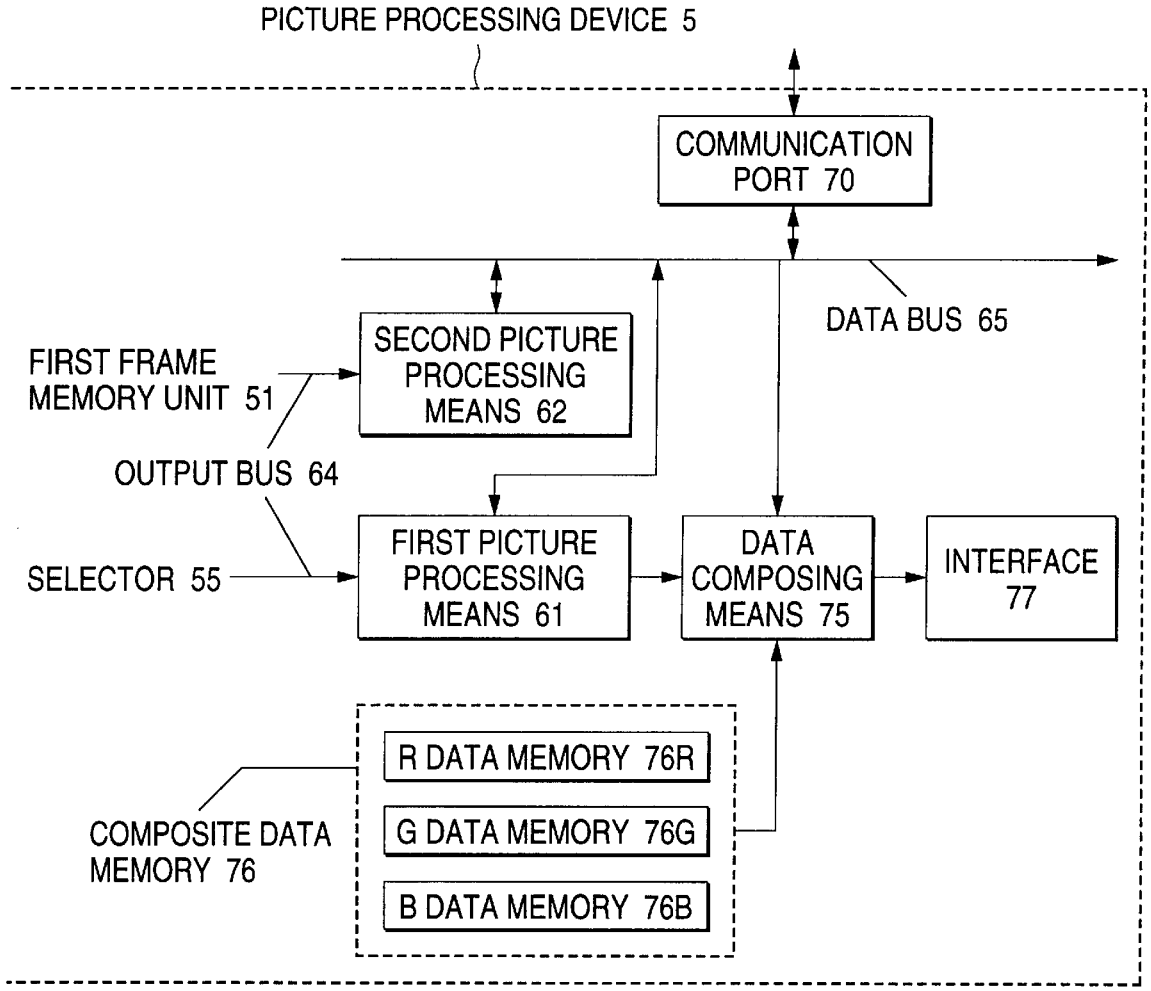
FIG. 6 is a block diagram illustrating the remainder of the construction of the picture processing device 5 shown in FIG. 2 (a part other than the part illustrated in FIG. 5).

The block diagram outlining the constitution of the picture processing device 5 is shown dividing into two figures, FIG. 5 and FIG. 6. As shown in these figures, the picture processing device 5 has interface 48 connectable to the interface 21 of the transmission-type image reading device 10 or the interface 41 of the reflection-type image reading device 30, an addition average operation means 49 in which the values of the data on every two adjacent pixels among the image data which are being produced by the image reading device 1 and transmitted therefrom in every line are summed and averaged to be made the data on each pixel, a first line buffer 50*a* and a second line buffer 50*b* in which the data on pixels in each line of the image data being transmitted from the addition average operation means 49 are memorized alternately, and first, second and third frame memory units 51, 52 and 53 to each of which the line data memorized in the line buffers 50*a* and 50*b* are transmitted and in each of which the image data corresponding to color images recorded in the film F (FIG. 4) are memorized for each frame. Additionally, the first line buffer 50*a* and the second line buffer 50*b* are constituted so that they perform alternate operations for memorizing the pixel data on the lines in odd numbers among the image data lines and those in even numbers among the image data lines.

In embodiments of the present invention, the color image recorded in one of the frames of the film F is first read with the image reading device 1 (the first read, referred to as "preliminary read" hereinafter), and then converted to digital image data. At this time, on the basis of the image data obtained by the preliminary read, the condition setup for the second read (referred to as "the main read") is made by the picture processing device 5. Under the thus set condition of reading, the aforesaid color image is read again, namely the main read is performed, and thereby the digital image data to receive picture processing for reproduction are produced. In order to perform such processing, the picture processing device 5 is constituted so that the image data obtained by the preliminary read are memorized in the first frame memory unit 51 and the image data obtained by the main read are memorized in the second frame memory unit 52 and the third frame memory unit 53.

Figure 7:
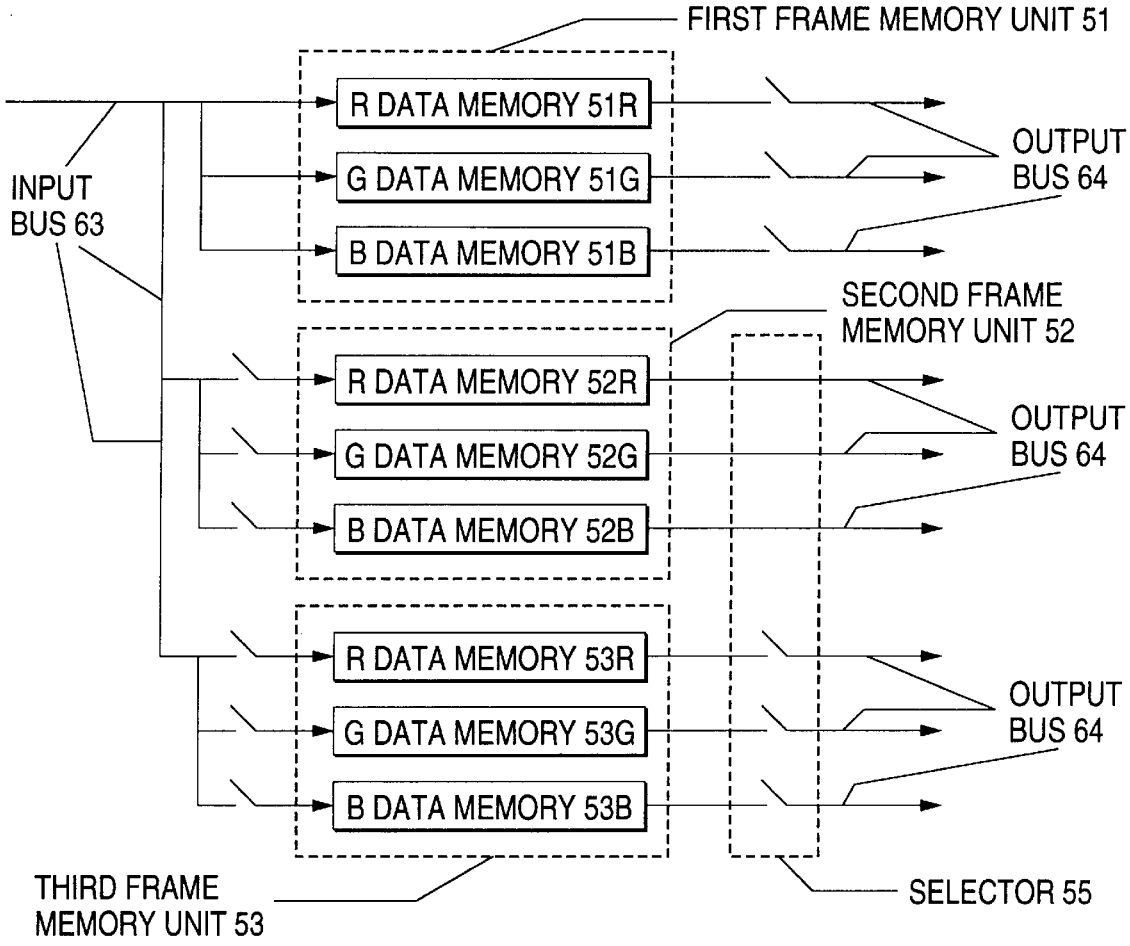
FIG. 7 is a block diagram illustrating details of the first frame memory unit, the second frame memory unit and the third frame memory unit.

Before explaining other constituent elements shown in FIG. 5 and FIG. 6, those frame memory units are described in detail. FIG. 7 is a block diagram showing details of the first frame memory unit 51, the second frame memory unit 52 and the third frame memory unit 53. In order that the picture processing device 5 processes the image data produced from the color images read, as shown in FIG. 7, each of the first, second and third frame memory units 51, 52 and 53 installed therein has R data memory, G data memory and B data memory to memorize the image data corresponding to R (red), G (green) and B (blue) respectively. Namely, the first frame memory unit 51 has R data memory 51R, G data memory 51G and B data memory 51B, the second frame memory unit 52 has R data memory 52R, G data memory 52G and B data memory 52B, and the third frame memory unit 53 has R data memory 53R, G data memory 53G and B data memory 53B. Additionally, FIG. 7 illustrates a state in which the image data obtained by preliminary read are put into the first frame memory unit 51 from an input bus 63 and the image data memorized in the second and third frame memory units 52 and 53 are transmitted to an output bus 64, although it is described above that the image data obtained by the preliminary read are memorized in the first frame memory unit 51 and the image data obtained by the main read are memorized in the second and the third frame memory units.

The constitution of the picture processing device 5 is explained again on the basis of FIG. 5 and FIG. 6. The picture processing device 5 is provided with CPU 60 for controlling the whole thereof. CPU 60 is disposed so as to enable the communication with CPU 26, which controls the transmission-type image reading device 10 (FIG. 4), via a communication line (not shown in the figure), and further with CPU for controlling an image output device 8 described hereinafter via a communication line (not shown in the figures). Owing to this lineup, the CPU 60 can alter conditions of the main read of color images on the basis of the image data obtained by the preliminary read and memorized in the first frame memory unit 51 and further, if needed, can alter conditions of the picture processing which the images will experience after they are read.

More specifically, at the time of main read, the CPU 60 determines the image reading conditions on the basis of the image data obtained by the preliminary read so as to enable efficient utilization of the dynamic range of CCD area sensor 15 or CCD line sensor 35 at the time of the main read, and transmits read control signals into the CPU 26 of the transmission-type image reading device 10 or the CPU 46 of the reflection-type image reading device 30 (although this device does not relate to the present invention). Upon input of these read control signals, the CPU 26 of the transmission-type image reading device 10 or the CPU 46 of the reflection-type image reading device 30 controls the quantity of light to be adjusted by the light quantity adjustment unit 12 or 34 and the storage time of the CCD area sensor 15 or the CCD line sensor 35. Simultaneously with this control, on the basis of the image data obtained, the CPU 60 transmits control signals to first and second picture processing devices described hereinafter, if needed, in order to change the picture processing conditions, such as parameters of the picture processing performed using first and second picture processing devices described hereinafter, so as to enable the reproduction of color images having the optimum density, gradation and tone on color paper. At this time, the image reading conditions or the picture processing conditions determined by the CPU 60 are memorized in a memory 66.

In performing the aforementioned control by use of the CPU 60, the determination of conditions based on the image data obtained by the preliminary read is not made by the CPU 60 when the image reading conditions or the picture processing conditions are maintained by the operator's indication, but the input of various control signals is performed under the maintained conditions. When an operator sets various conditions by the use of an input device, such as a keyboard 69, and instructs the maintenance of the set conditions, these conditions are memorized in the memory 66. The conditions memorized in the memory 66 become null when an operator instructs the cancellation of these maintained conditions. In performing the foregoing control, therefore, the CPU 60 refers first to the conditions memorized in the memory 66. When conditions are memorized, the CPU 60 follows the memorized conditions; while, when there are no memorized conditions, it determines conditions on the basis of the image data obtained by preliminary read. Accordingly, an operator can give indications on such condition setup as to meet the type of each film in accordance with the read from DX code or special orders from customers, or the conditions are set in advance for various film types respectively and the processing can be designed so as to automatically follow the indications made in advance. Additionally, it is not always necessary that the maintenance of conditions be carried out in a great unit, such as an image reading condition or a picture processing condition, but the memorization of the foregoing conditions in the memory 66 may be designed so as to be performed for each detailed condition and thereby, for example, it becomes possible that the saturation setup is maintained but the automatically determined condition is adopted for sharpness.

As far as it is shown in FIG. 5, the constitution of the picture processing device 5 is explained above. Therein, detailed explanations are made as to the processing which the image data undergo from the step of putting the image data, which is produced in the image reading device 1, in the picture processing device 5 via the interface 48 till the step of memorizing the processed image data in the first to the third frame memory units.

In the next place, explanation is given to the constitution which the picture processing device 5 has in order to perform the picture processing of the image data memorized in the second frame memory unit 52 and the third frame memory unit 53 as the result of the main read.

The picture processing device 5 has a first picture processing means 61 (FIG. 6) in which the image data memorized in the second frame memory unit 52 and the third frame memory unit 53 undergo the picture processing, including gradation correction, color change and density change, by means of a look-up table and a matrix operation so as to enable the reproduction of color images having the desired density, gradation and tone on color paper, and a second picture processing means 62 (FIG. 6) in which the image data memorized in the first frame memory unit 51 undergo the picture processing, including gradation correction, color change and density change, by means of a look-up table and a matrix operation so as to enable the reproduction of color images having the desired image quality on a CRT screen described hereinafter. The output of the second frame memory unit 52 and that of the third frame memory unit 53 are connected to a selector 55, and the image data memorized in either the second frame memory unit 52 or the third frame memory unit 53 are selectively put in the first picture processing means 61.

Figure 8:
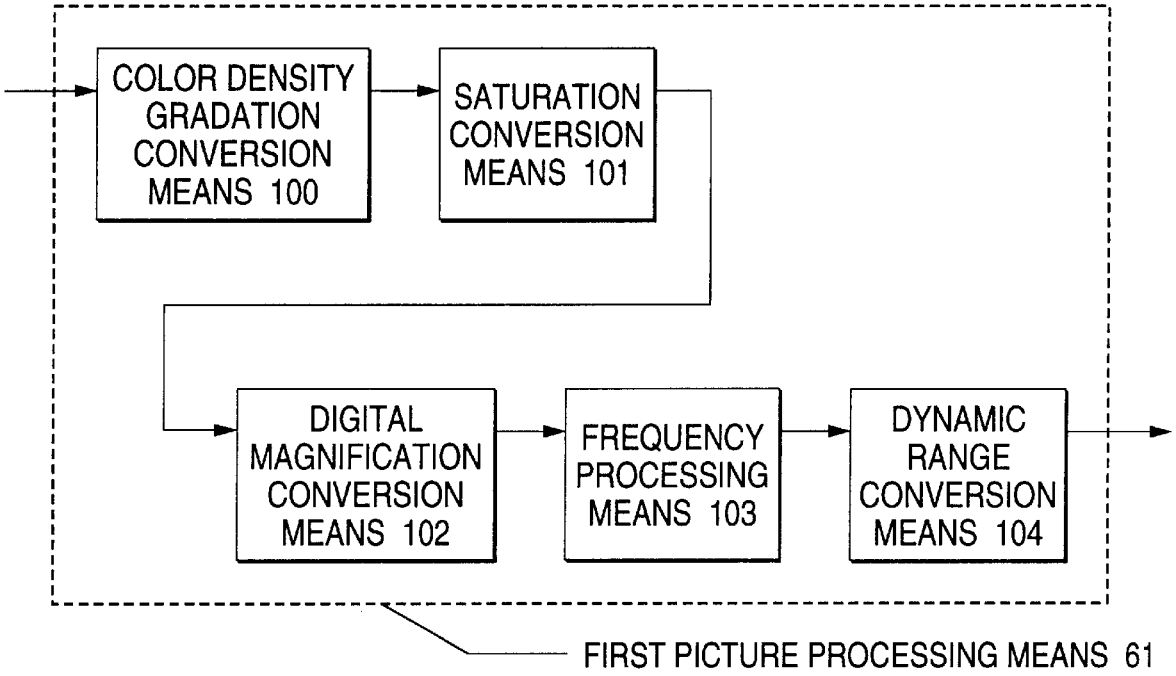
FIG. 8 is a block diagram illustrating details of the first picture processing means shown in FIG. 6.

FIG. 8 is a block diagram showing the detail of the first picture processing means 61. As shown in FIG. 8, the first picture processing means 61 consists of a color density gradation conversion means 100 for changing the density data, the color data and the gradation data of image data, a saturation conversion means 101 for changing the saturation data of image data, a digital magnification conversion means 102 for changing the number of pixel data of image data, a frequency processing means 103 for subjecting image data to frequency processing, and a dynamic range conversion means 104 for changing the dynamic range of image data. As usually referred to as "pipeline processing", these conversion means operates simultaneously, and followed by processing of next conversion means after the operation of one conversion means is finished. Thus, high-speed processing becomes possible.

The picture processing means shown in FIG. 8 enables not only the processing for a correction of gradation, a change of color, a change of density and the like, but also the processing for improvement of sharpness accompanied by graininess control of a film (the patent application of this art is pending as Japanese Patent Application No. 7-337510 (which corresponds to JP-A-9-22460)). Further, this means enables an automatic dodging processing which can result in a satisfactory image reproduction in the case of images having a great constant between light and shade (this art is also applied for patent, and pending as Japanese Patent Application No. 7-165965 (which corresponds to JP-A-9-18704)).

The first picture processing means 61 is connected to the data composing means 75 shown in FIG. 6, to which the composite data memory 76 is connected. The composite data memory 76 comprises R data memory 76R, G data memory 76G and B data memory 76B which store the image data such as figures and letters corresponding to R (red), G (green) and B (blue), respectively. The composite data memory 76 stores the image data such as figures and letters which should be composed with the image data obtained by reading the color image recorded on the film F (see FIG. 3) or the color print P (see FIG. 4), when the image data obtained by reading color image recorded on the film F or the color print P are composed with the image data stored in the composite data memory 76 to reproduce a color image on color paper by image output device 8, which will be described below. The date composing means 75 is connected to interface 77.

In the present invention, films themselves are designed so as to have (i) soft gradation, (ii) very low Dmin, (iii) decrease in saturation improvement through interimage effect and (iv) reduction in fine granulation effect arising from DIR couplers, and these features become more predominant when the films undergo rapid development processing. In each of the processing means mentioned above, therefore, the condition setup is made in order to effect the picture processing for correcting the read and digitized image information concerning those photographic characteristics so as to result in reproduction of images having standard quality and, on the basis of this condition setup, the change into standard photographic characteristics is performed. The changed image information is once stored, and then made to proceed into the step of transmission to a printer as positive images.

In such a chain of picture processing operations as described above, the correction of the soft gradation designated above by (i) is effected by using the combination of a dynamic range conversion means 104 and a gradation conversion means 100 to modify the shape of a characteristic curve in the toe portion and the high density portion in the direction of an approach to the shape obtained in the case of basic development processing characteristics. And at the same time, in the correction for the low Dmin designated by (ii), a kind of zero-point adjustment operation is carried out wherein Dmin of the read film, or the lowest value in the image data group obtained by statistical read is adjusted to the base line of the basic characteristic curve (the characteristic curve in the case of basic development processing) built in CPU 100. With respect to (iii), the emphasis laid on saturation is set at a high level in the saturation conversion means 101. That is, a correction is made in such a direction that the input signal is shifted so as to go away from the origin of La*b* frame of reference by the distance corresponding to the shortage of interimage effect, namely the direction of raise in saturation. The extension of a toe portion which directly influences the sensitivity is corrected by the combined use of the aforementioned saturation emphasis of the saturation conversion means 101, the dynamic range conversion means 104 and the gradation conversion means 100. In addition, the image sharpness is improved by correcting the shape of a characteristic curve in the toe and high density portions from a combination of a change in density amplification degree of the high spacial frequency component by a frequency processing means 103 and a control of gradation by the gradation conversion means 100. In this case also, if the reproduction of gradation (increase of contrast) and the reproduction of basic development processing characteristics under the previously set picture processing conditions are insufficient, the setup of picture processing conditions is made again.

The image sharpness in the total and fine image areas can be further improved by the introduction of the processing for emphasizing the fringe and the processing for raising the gradation in the low density area, and this improvement can be produced by the use of a frequency processing means 103. More specifically, the spacial frequencies in image areas are analyzed, and the emphasis processing is set for the fringe part having a great change in frequency and the fine image area having high frequencies.

The satisfactory accuracy of image information correction by the aforementioned picture processing is, as described hereinbefore, within 10% on the target value set as the density value, preferably within 8%. With respect to the color balance and the gradation characteristics also, the reproduction thereof is judged satisfactory as for as the density value is within the foregoing range.

In changing into standard photographic characteristic values, the condition of the change processing may be automatically selected by previously setting the condition for each type of film and reading the type of a film to be processed, or an operator may specify the condition of the change processing for each film processed.

The operational gist of a picture processing device used in the aforementioned picture processing is disclosed in JP-A-10-020457 and JP-A-9-146247.

Besides the input bus 63 and the output bus 64 for the first frame memory unit 51, the second frame memory unit 52 and the third frame memory unit 53, the data bus 65 is installed in the picture processing device 5. By communication lines, the data bus 65 is connected to the CPU 60 which controls the color image reproduction system as a whole, the memory 66 which stores the operation program of the CPU 60 or the data on picture processing conditions, a hard disk 67 which can memorize image data and store them, CRT 68, a keyboard 69, a communication port 70 connected to another color reproduction system via a communication circuit, the CPU 26 of the transmission-type image reading device 10, and so on.

3) Output of picture-processed image signals into printer;

The constitution of the picture processing device 5 shown in FIG. 2 and FIG. 3 is described above in detail. In the next place, an image output device 8 which is also shown in FIG. 2 and FIG. 3 is explained below.

Figure 9:
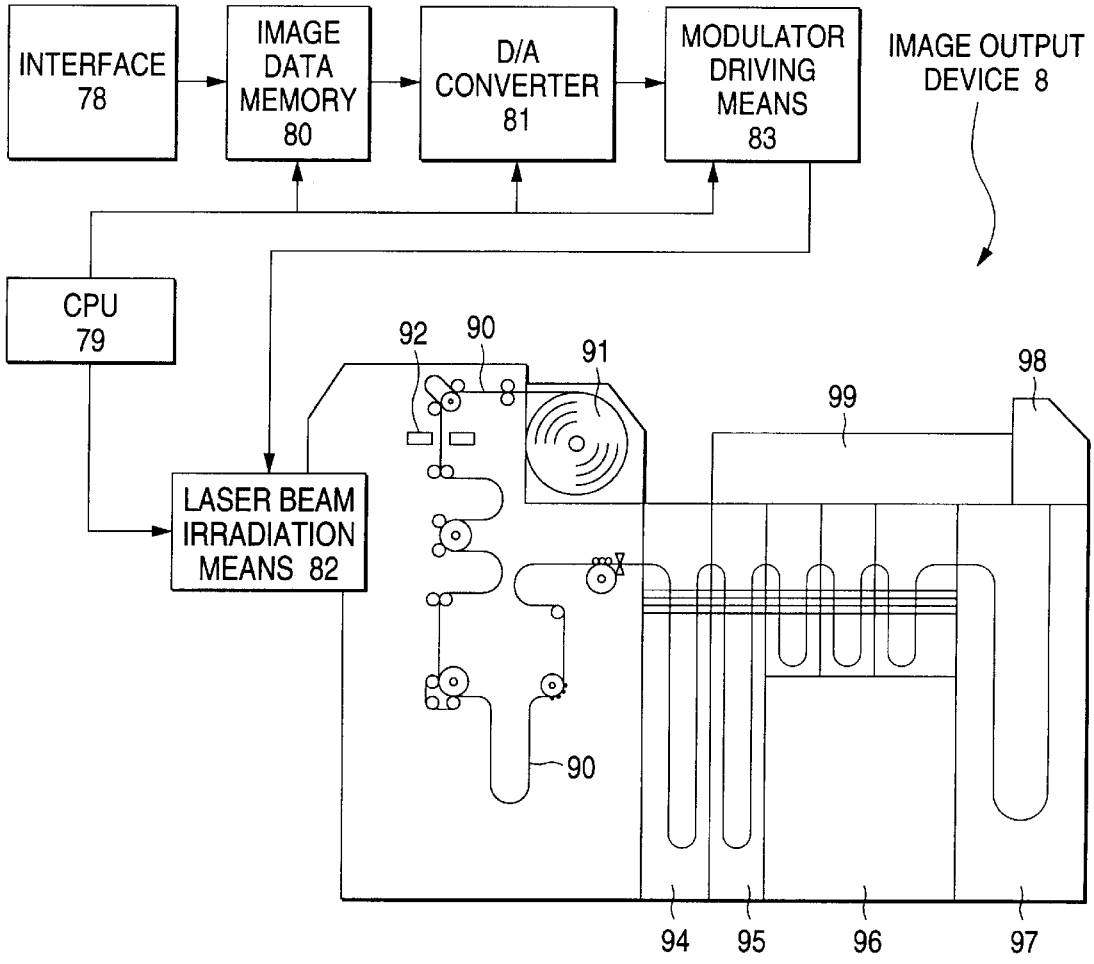
FIG. 9 is a schematic view of the image output device shown in FIG. 2.

In the present invention, explanation of the output of image information centers on color paper as the main object of output. However, the object of an image information output in the present invention should not be construed as being limited to color paper. FIG. 9 is a schematic diagram of an image output device 8 for color image reproduction system in which color images are reproduced on color paper on the basis of the image data processed using an picture processing device according to a preferred embodiment of the present invention.

As shown in FIG. 9, the image output device 8 has an interface 78 capable of being connected to the interface 77 of the picture processing device 5, CPU 79 to control the image output device 8, an image data memory 80 constituted of two or more frame memories wherein the image data input from the picture processing device 5 are memorized, a D/A converter 81 to convent the image data into analog signals, a laser-beam irradiation means 82, and a modulator driving means 83 to transmit modulation signals for modulating the intensity of laser beams. The CPU 79 is disposed so as to enable the communication with the CPU 60 of the picture processing device 5 via a communication line (not shown in the figure).

Figure 10:
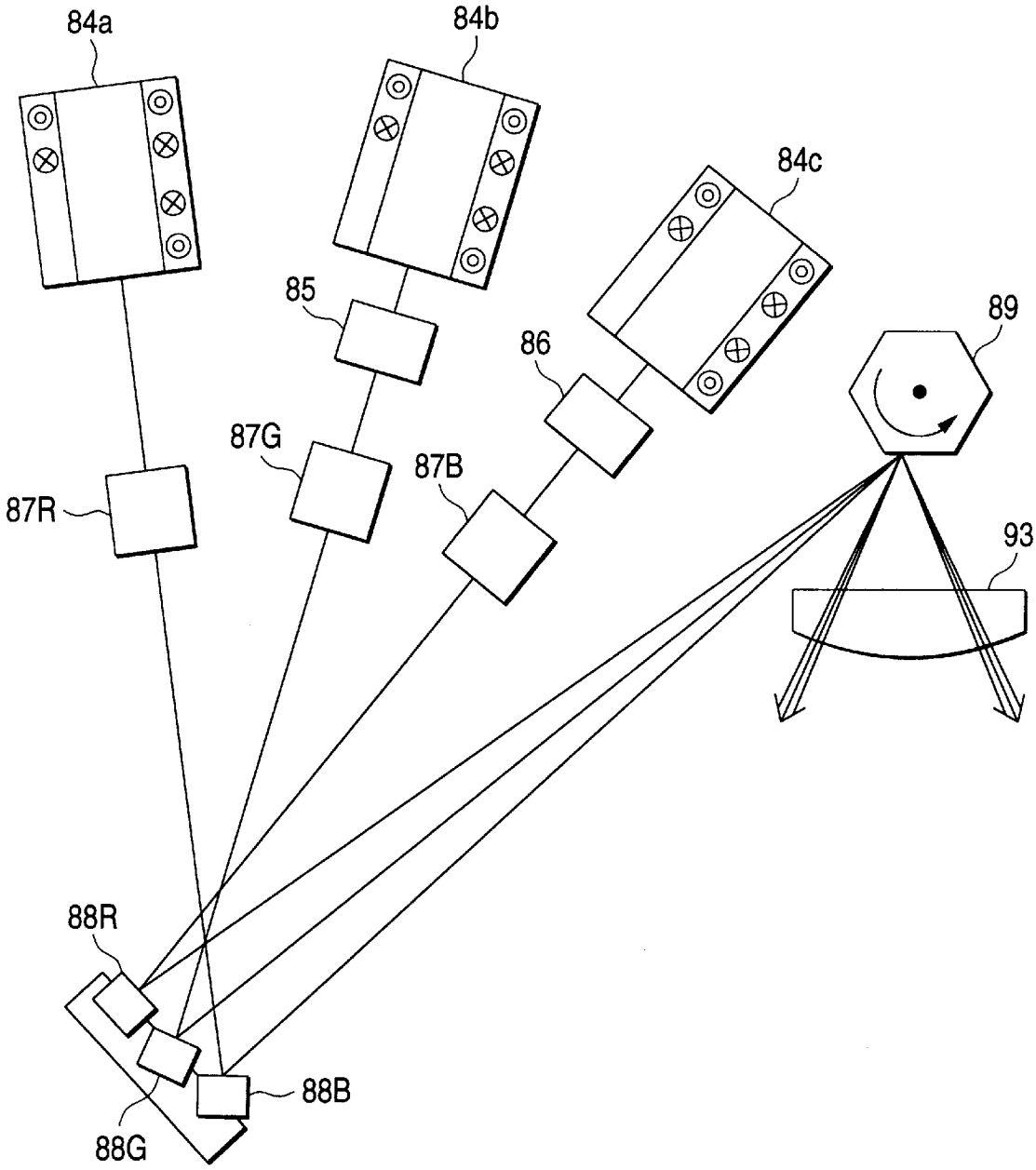
FIG. 10 is a laser-beam irradiation means of the image output device shown in FIG. 9.

FIG. 10 is a schematic diagram of the laser beam irradiation means 82 shown in FIG. 9. The laser irradiation means 82 is equipped with semiconductor laser beam sources 84*a*, 84*b* and 84*c*. The laser beam emitted from the semiconductor laser beam source 84*b* is changed into a green laser beam having the wavelength of 532 nm by the wavelength conversion means 85, and the semiconductor laser beam source 84*c* is changed into a blue laser bean having the wavelength of 473 nm by the wavelength conversion means 86.

The red laser beam emitted from the semiconductor laser beam source 84*a*, which has its wavelength in the range of 670 to 690 nm, the green laser beam which has undergone a frequency conversion through the frequency conversion means 85, and the blue laser beam which has undergone a frequency conversion through the frequency conversion means 86 are disposed so as to enter into light modulators, e.g., acoustic optical modulators (AOM), 87R, 87G and 87B respectively, and modulation signals from the modulator driving means 83 are fed into the light modulators 87R, 87G and 87B respectively. Thus, the intensities of laser beams are modulated depending on the modulation signals. At this time, the semiconductor laser beam source 84*a* is directly modulated so far as it can undergo a high-speed operation, and thereby the light modulator 87R can be omitted.

The laser beams modulated in intensity by the light modulators 87R, 87G and 87B are reflected by reflection mirrors 88R, 88G and 88B, and made to be incident on a polygon mirror 89; while paper is transported at a speed of about 75 mm per second. Thus, the scanning line density is 600 per inch and each pixel is modulated every 100 nsec.

The image output device 8 is equipped with a magazine 91 in which color paper 90 is stored in the form of roll, and designed so that the color paper 90 is transported along the predetermined transport path at a speed of about 110 mm per second in the side scanning direction. The color paper used in this device may have its width in the range of 89 mm to 210 mm, and it may be not only general color paper used in mini laboratories but also exclusive color paper for the high illumination short exposure characteristic of laser exposure. As for the magazine 91, those used in general mini laboratories, e.g., the magazine described in JP-A-6-161050, can be also used herein. At a certain place along the transport path is arranged a punching means 92 for punching basic holes in the side edges of the color paper 90 at each interval corresponding to the length of a sheet of color print. Inside the image output device 8, the transport of color paper 90 is devised so as to synchronize with the drive of other means.

The laser beams modulated with the light modulators 87R, 87G and 87B are scanned in the main scanning direction with the polygon mirror 89, and therewith the color paper 90 is irradiated via lens 93. Herein, the color paper 90 is transported in the side scanning direction, so that the color paper surface is exposed to laser beams all over. The transport speed of the color paper 90 in the side scanning direction is controlled by CPU 79 so as to synchronize with the main scanning speed of laser beams, or the rotating speed of the polygon mirror 89.

The laser beams-irradiated color paper 90 is fed into a development processing section 94 at a speed of about 29 mm per second, and therein subjected to prescribed color development, bleach-fix and washing. Thus, color images are reproduced on the color paper 90 on the basis of the image data which has undergone the picture processing by the picture processing device 5. The color paper 90 which has undergone the color development, bleach-fix and washing operations using a color developing tank 94, a bleach-fix bath 95 and a washing tank 96 respectively is fed into a drying section 97, and dried. After drying, the color paper 90 is cut in lengths corresponding to color images recorded in one frame of film F or one sheet of color paper P with a cutter 98 which is driven synchronously with the transport of the color paper 90 on the basis of the basic holes punched in the side edges of the color paper 90, and fed into a sorter 99. The sorter 99 is devised so that the color paper thus cut in sheets are accumulated every number of frames present in a roll of film F or every customer. Separately from this application, this sorter is also applied for a patent (Japanese Patent Application No. 2-332146 (which corresponds to JP-A-4-199052)).

As each of the foregoing components, a color developing tank 94, a bleach-fix tank 95, a washing tank 96, a drying section 97, a cutter 98 and a sorter 99, those installed in automatic developing machines generally used for mini laboratories can be utilized. Although the processing system CP47L is adopted in embodiments of the present invention, the present method can also deal with other all-purpose processing systems as well as the processing system CP40FA and CP43FA (using the development processing defined by and photographic materials made by Fuji Photo Film Co., Ltd.).

The image output device according to embodiments of the present invention is devised so as to perform calibration for steady image reproduction through absorption of variation in characteristics of a color paper to be used and variations in respective characteristics of laser beam source, modulator and development processing machine. First, color paper is subjected to exposure operations respectively using a cyan color ray of light, a magenta color ray of light, a yellow color ray of light and gray light as superimpose of these monochromatic rays via a plurality of density step patterns based on the density data memorized as digital data, and developed. Then, the developed densities are measured automatically with a densitometer, and the table for memorizing the characteristic values of electric signals given to the modulator at the time of exposure is rewritten for obtaining density to be reproduced on the basis of the difference between the measured densities and the intended densities. Thus, it becomes possible to steadily reproduce images without affected by variations in paper and device used and fluctuation in environmental conditions. As mentioned above, the image output device is managed to ensure the steady reproduction of images.

III. Positive Photographic Materials for Output Use

As already mentioned hereinbefore, any material on which electric or optical image signals converted into time series are recorded, for example, any of ink jet recording paper, sublimation type heat-sensitive transfer paper, color diffusion transfer paper, color electrophotographic paper, heat-developable silver salt color diffusion transfer paper, heat-developable multilayer color diazo paper and silver salt color photographic paper can be employed as materials to provide positive images.

Of those papers, color paper is preferred over the others. It is desirable for light-sensitive silver halide emulsions in a photographic material to comprise silver halide grains containing at least 95 mole % of silver chloride and the remainder silver bromide but no silver iodide in a substantial sense. The expression "no silver iodide in a substantial sense" as used herein means that the silver iodide content is not more than 1 mole %, preferably not more than 0.2 mole %, and particularly preferably 0 mole %. From the viewpoint of rapid processability, silver halide emulsion having a silver chloride content of at least 98 mole % are preferred in particular. Of these high silver chloride content emulsion grains, those having a structure such that silver bromide-localized phases are present at the surface of silver chloride grains are favored because they can ensure high sensitivity and stabilization of photographic properties.

It is desirable for at least one light-sensitive silver halide emulsion layer to contain a monodisperse silver halide emulsion having a variation coefficient of not greater than 15%, preferably not greater than 10%, with respect to the grain size distribution (the term "variation coefficient" as used herein refers to the quotient of the standard deviation of the grain size distribution divided by the average grain size). For the purpose of obtaining a wide latitude, it is desirable to use a mixture of two or more kinds of monodisperse emulsions in one layer. In this case, it is desirable for the monodisperse emulsions to be mixed that the difference in average grain size between them be at least 15%, preferably from 20 to 60%, particularly preferably 25 to 50%, and the difference in sensitivity between them be from 0.15 to 0.50 logE, preferably from 0.20 to 0.40 logE, particularly preferably from 0.25 to 0.35 logE.

In order to achieve the image gradation intended by the present invention, it is effective to use a silver halide emulsion comprising silver chloroiodide grains which contain at least 95 mole % of silver chloride, substantially no silver iodide and $1\times10^{-5}$ to $1\times10^{-3}$ mole/mole AgCl of iron and/or ruthenium or/and osmium compounds and further have silver bromide-localized phases into which an iridium compound is incorporated in an amount of $1\times10^{-7}$ to $1\times10^{-5}$ mole/mole Ag.

To silver halide photographic materials used for the image reproduction in the present invention, hitherto known photographic constituent materials and additives can be applied.

For instance, supports of both transmission and reflection types are usable as a photographic support in the present invention. Suitable examples of a support of transmission-type include not only a transparent film of cellulose nitrate or polyethylene terephthalate, but also a film of, e.g., the polyester of 2,6-naphthalenedicarboxylic acid (NDCA) and ethylene glycol (EG) or the polyester of NDCA, terephthalic acid and EG, coated with an information recorded layer, such as a magnetic layer. For achievement of the present objects, supports of reflection-type are used to advantage. In particular, a support laminated with two or more of polyethylene or polyester layers (waterproof resin layers) at least one of which contains a white pigment such as titanium oxide is preferred over the others.

Preferably, the foregoing waterproof resin layer(s) further contains a brightening agent. Also, a brightening agent may be dispersed into a hydrophilic colloid layer of the photographic material. Suitable examples of a brightening agent which can be used in such layers include brightening agents of benzoxazole, coumarin and pyrazoline types. Of these agents, the brightening agents of benzoxazolylnaphthalene and benzoxazolylstilbene types are preferred over the others. These agents have no particular limitation on the amount used. However, the desirable range of the amount used is from 1 to 100 mg/m$^2$. In the case of mixing such a brightening agent with a waterproof resin, it is desirable that the proportion of the agent to the resin be from 0.0005 to 3 weight %, preferably from 0.001 to 0.5 weight %.

Also, the transparent support may be a support coated with a hydrophilic colloid layer containing a white pigment.

Furthermore, the reflection-type support may have a specular reflectiveness or a metal surface having secondary diffuse reflectiveness.

In order to render the present image reproduction system compact and inexpensive, it is desirable to use a second harmonic wave generating light source (SHG) in which semiconductor laser or solid laser is combined with a non-linear optical crystal. In particular, the use of semiconductor layer is preferred for the purpose of designing a low-priced compact device having a long life and high stability, and it is advantageous to use semiconductor laser as at least one of the light sources for exposure.

In the case of using such a light source for scanning exposure, the spectral sensitivity maximums of a color photographic material for image reproduction can be set optionally at the wavelengths depending on the wavelengths of light sources used for scanning exposure. When the solid laser using semiconductor laser as an excitation light source or an SHG light source obtained by combining semiconductor laser with a non-linear optical crystal is employed, the oscillation wavelength of laser can be reduced to one-half its initial value, so that blue color light and green color light can be obtained. Therefore, the use of such light sources can permit a photographic material to have its spectral sensitivity maximums in usual three wavelength regions, namely blue, green and red wavelength regions.

The suitable exposure time for such scanning exposure is not longer than $10^{-4}$ second, preferably not longer than $10^{-6}$ second, expressed in terms of the time required for exposure of a pixel size when the pixel density is 400 dpi.

IV. Color Negative Film

Since reduction of the amounts of couplers added and so on is already described as a means of not only reducing mask densities but also lowering Dmin, contrast and Dmax, supplementary explanations of color negative films usable in the present invention are added below.

Color negative films according to the present invention are those obtained by introducing modifications of gradation, Dmax and Dmin into general color negative films which are made by various makers and on the market today.

An representative of the present color negative films is a silver halide photographic material having at least one light-sensitive layer constituted of two or more silver halide emulsion layers which have substantially the same color sensitivity but different sensitivities. This light-sensitive layer is a unit light-sensitive layer having the color sensitivity to one of the three different color lights, namely red light, green light or blue light. The general arrangement of unit light-sensitive layers in a multilayer silver halide color photographic material is such that a red-sensitive layer, a green-sensitive layer and a blue-sensitive layer are provided over a support in the order of description. However, this arranging order may be reversed, or an arrangement such that a different sensitive layer is inserted between the same color sensitive layers may be adopted, depending on the end-use purpose of the photographic material. Further, light-insensitive layers may be provided between silver halide light-sensitive layers or as the uppermost and the lowermost layers. In these insensitive layers, the couplers as described below, DIR compounds, color stain inhibitors and so on may be contained. Among a plurality of silver halide emulsion layers to constitute each unit light-sensitive layer, as described in German Patent 1,121,470 or British Patent 923,045, it is desirable to arrange them so that the sensitivity decreases successively in the direction of the support, for example, it is desirable to provide a low-sensitivity emulsion layer and a high-sensitivity emulsion layer over a support in this order. On the other hand, as described in JP-A-57-112751, JP-A-62-200350, JP-A-62-206541 and JP-A-62-206543, a low-sensitivity emulsion layer may be arranged on the side distant from the support and a high-sensitivity emulsion layer on the side near to the support.

Specific examples of the layer arrangement include from the farthest side from the support, an order of a low-sensitivity blue-sensitive layer (BL)/a high-sensitivity blue-sensitive layer (BH)/a high-sensitivity green-sensitive layer (GH)/a low-sensitivity green-sensitive layer (GL)/a high-sensitivity red-sensitive layer (RH)/a low-sensitivity red-sensitive layer (RL), an order of BH/BL/GL/GH/RH/RL and an order of BH/BL/GH/GL/RL/RH. Also, as described in JP-B-55-34932 (the term "JP-B" as used herein means an "examined Japanese patent publication"), a blue-sensitive layer/GH/RH/GL/RL may be provided in this order from the farthest side from the support. Further, as described in JP-A-56-25738 and JP-A-62-63936, a blue-sensitive layer/GL/RL/GH/RH may be provided in this order from the farthest side from the support. Furthermore, a three-layer structure may be used as described in JP-B-49-15495, where a silver halide emulsion layer having highest sensitivity is provided as an upper layer, a silver halide emulsion layer having sensitivity lower than that of the upper layer is provided as a middle layer and a silver halide emulsion layer having sensitivity lower than that of the middle layer is provided as a lower layer so that the sensitivity decreases in sequence towards the support. Even in the case of the construction comprising three layers different in the sensitivity, a middle-sensitivity emulsion layer/a high-sensitivity emulsion layer/a low-sensitivity emulsion layer may be provided in this order from the side farther from the support within the same spectral sensitive layers as described in JP-A-59-202464. In addition, an order of a high-sensitivity emulsion layer/a low-sensitivity emulsion layer/a middle-sensitivity emulsion layer or an order of a low-sensitivity emulsion layer/a middle-sensitivity emulsion layer/a high-sensitivity emulsion layer may also be used. Also when four or more layers are provided, the layer arrangement may be varied as described above. In order to improve the color reproducibility, a donor layer (CL) having an interimage effect and having a spectral sensitivity distribution different from the main light-sensitive layers such as BL, GL and RL is preferably provided adjacent to or in the vicinity of the main light-sensitive layers as described in U.S. Pat. Nos. 4,663,271, 4,705,744 and 4,707,436, JP-A-62-160448 and JP-A-63-89850.

The silver halide preferably used in the present invention is silver iodobromide, silver iodochloride or silver iodochlorobromide having a silver iodide content of about 30 mole % or less, more preferably silver iodobromide or silver iodochlorobromide having a silver iodide content of from about 2 to about 10 mole %. The silver halide grain in the photographic emulsion may have a regular crystal form such as cubic, octahedral or tetradecahedral form, an irregular crystal form such as spherical or platy form, a crystal defect such as twin, or a composite form thereof. The silver halide grain may be a fine grain having a grain diameter of about 0.2 $\mu$m or less or a large-sized grain having a grain diameter in terms of the projected area diameter up to about 10 $\mu$m. Further, either a polydisperse emulsion or a monodisperse emulsion may be used. The silver halide photographic emulsion which can be used in the present invention can be prepared according to the method described, for example, in *Research Disclosure* (hereinafter simply referred to as "RD") No. 17643, pp. 22–23, "I. Emulsion Preparation and Types" (December, 1978), ibid., No. 18716, p. 648 (November, 1979), ibid., No. 307105, pp. 863–865 (November, 1989), P. Glafkides, *Chemie et Phisique Photographique*, Paul Montel (1967), G. F. Duffin, *Photographic Emulsion Chemistry*, The Focal Press (1966), and V. L. Zelikman et al., *Making and Coating Photographic Emulsion*, The Focal Press (1964).

Monodisperse emulsions described in U.S. Pat. Nos. 3,574,628 and 3,655,394 and British Patent 1,413,748 are also preferred. Tabular grains having an aspect ratio of about 3 or more can also be used in the present invention. Tabular grains can be easily prepared by the method described in Gutoff, *Photographic Science and Engineering*, Vol. 14, pp. 248–257 (1970), U.S. Pat. Nos. 4,434,226, 4,414,310, 4,433,048 and 4,439,520 and British Patent 2,112,157.

The silver halide emulsion is usually subjected to physical ripening, chemical ripening and spectral sensitization before use. The additives used in these steps are described in RD Nos. 17643, 18716 and 307105, and the pertinent portions thereof are summarized in the table below. In the light-sensitive material of the present invention, two or more kinds of emulsions different at least in one property of grain size, grain size distribution, halogen composition, grain from and sensitivity of the light-sensitive silver halide emulsion can be mixed and used in the same layer. A silver halide grain with the grain surface being fogged described in U.S. Pat. Nos. 4,082,553, a silver halide grain with the inside of the grain being fogged described in U.S. Pat. No. 4,626,498 and JP-A-59-214852, or colloidal silver may be used in a light-sensitive silver halide emulsion layer and/or a substantially light-insensitive hydrophilic colloidal layer depending on the purpose. The silver halide grain with the inside or surface of the grain being fogged means a silver halide grain capable of uniform (namely, non-imagewise) development irrespective of unexposed area and exposed area of the photographic material. The preparation method thereof is described in U.S. Pat. No. 4,626,498 and JP-A-59-214852. The silver halide forming the internal nucleus of a core/shell type silver halide grain with the inside of the grain being fogged may have a different halide composition. The silver halide for a grain with the inside or surface thereof being fogged may be any of silver chloride, silver chlorobromide, silver iodobromide and silver chloroiodobromide. The fogged silver halide grain preferably has an average grain size of from 0.01 to 0.75 $\mu$m, more preferably from 0.05 to 0.6 $\mu$m.

The color negative film for use in the present invention may also use a light-insensitive fine grain silver halide. The term "light-insensitive fine grain silver halide" as used herein means a silver halide fine grain which is not sensitive to light at the time of imagewise exposure for obtaining a dye image and substantially not developed at the time of development processing. The light-insensitive fine grain silver halide is preferably not fogged previously. The fine grain silver halide has a silver bromide content of from 0 to 100 mole % and may contain, if desired, silver chloride and/or silver iodide. It preferably contains from 0.5 to 10 mole % of silver iodide. The fine grain silver halide has an average grain diameter (an average of equivalent-circle diameters of the projected area) of preferably from 0.01 to 0.5 $\mu$m, more preferably from 0.02 to 0.2 $\mu$m. The fine grain silver halide can be prepared by the same method as the preparation method of normal light-sensitive silver halide.

The photographic additives which can be used in the negative film for use in the present invention are also described in RDs and the portions having the pertinent description are shown in Table 1 below.

TABLE 1

| Kinds of Additives | RD17643 | RD18716 | RD307105 |
|---|---|---|---|
| 1. Chemical sensitizer | p. 23 | p. 648, right col. | p. 866 |
| 2. Sensitivity increasing agent | | p. 648, right col. | |
| 3. Spectral sensitizer, supersensitizer | pp. 23–24 | p. 648, right col.-p. 649, right col. | pp. 866–868 |
| 4. Whitening agent | p. 24 | p. 647, right col. | p. 868 |
| 5. Light absorbent, filter dye, UV absorbent | pp. 25–26 | p. 649, right col.-p. 650, left col. | p. 873 |
| 6. Binder | p. 26 | p. 651, left col. | pp. 873–874 |
| 7. Plasticizer, lubricant | p. 27 | p. 650, right col. | p. 876 |
| 8. Coating aid, surface active agent | pp. 26–27 | p. 650, right col. | pp. 875–876 |
| 9. Antistatic agent | p. 27 | p. 650, right col. | pp. 876–877 |
| 10. Matting agent | | | pp. 878–879 |

Various dye-forming couplers can be used in the color negative film for use in the present invention and the following couplers are particularly preferred.

Yellow Coupler

Couplers represented by formula (I) or (II) of EP-A-502424; couplers represented by formula (1) or (2) (particularly, Y-28 at page 18) of EP-A-513496; couplers represented by formula (I) in claim 1 of EP-A-568037; couplers represented by formula (I) in column 1, lines 45 to 55 of U.S. Pat. No. 5,066,576; couplers represented by formula (I) in paragraph 0008 of JP-A-4-274425; couplers (particularly, D-35 at page 18) described in claim 1 at page 40 of EP-A-498381; couplers represented by formula (Y) at page 4 (particularly, Y-1 (page 17) and Y-54 (page 41)) of EP-A-447969; couplers represented by formula (II), (III) or (IV) in column 7, lines 36 to 58 (particularly, II-17, II-19 (column 17) and II-24 (column 19)) of U.S. Pat. No. 4,476,219;

Magenta Coupler

Compounds L-57 (page 11, right lower column), L-68 (page 12, right lower column) and L-77 (page 13, right lower column) of JP-A-3-39737; Compounds A-4-63 (page 134), A-4-73 and A-4-75 (page 139) of EP-A-456257; Compounds M-4, M-6 (page 26) and M-7 (page 27) of EP-A-486965; Compound M-45 (page 19) of EP-A-571959; Compound M-1 (page 6) of JP-A-5-204106; Compound M-22 in paragraph 0237 of JP-A-4-362631;

Cyan Coupler

Compounds CX-1, CX-3, CX-4, CX-5, CX-11, CX-12, CX-14 and CX-15 (pages 14 to 16) of JP-A-4-204843; Compounds C-7, C-10 (page 35), C-34, C-35 (page 37), (I-1) and (I-17) (pages 42 and 43) of JP-A-4-43345; couplers represented by formula (Ia) or (Ib) in claim 1 of JP-A-6-67385; and Polymer Coupler Compounds P-1 and P-5 (page 11) of JP-A-2-44345.

Preferred examples of the coupler which provides a colored dye having an appropriate diffusibility include those described in U.S. Pat. No. 4,366,237, British Patent 2,125,570, EP-B-96873 and German Patent 3,234,533. Preferred examples of the coupler for correcting unnecessary absorption of a colored dye include yellow colored cyan couplers represented by formula (CI), (CII), (CIII) or (CIV) described at page 5 of EP-A-456257 (particularly, Compound YC-86 at page 84); Yellow Colored Magenta Couplers ExM-7 (page 202), EX-1 (page 249) and EX-7 (page 251) described in EP-A-456257; Magenta Colored Cyan Couplers CC-9 (column 8) and CC-13 (column 10) described in U.S. Pat. No. 4,833,069; and colorless couplers with masking-function represented by formula (2) (column 8) of U.S. Pat. No. 4,837,136 or formula (A) in claim 1 of WO92/11575 (particularly, compounds described at pages 36 to 45). Examples of the compound (including coupler) which releases a photographically useful compound residue upon reaction with an oxidation product of the developing agent include the following:

Development Inhibitor-Releasing Compound

Compounds represented by formula (I), (II), (III) or (IV) described at page 11 of EP-A-378236 (particularly, T-101 (page 30), T-104 (page 31), T-113 (page 36), T-131 (page 45), T-144 (page 51) and T-158 (page 58)); compounds represented by formula (I) described at page 7 of EP-A-436938 (particularly, D-45 (page 51)); compounds represented by formula (1) of EP-A-568037 (particularly, Compound (23) at page 11); and compounds represented by formula (I), (II) or (III) described at pages 5 and 6 of EP-A-440195 (particularly, Compound I-(1) at page 29);

Bleaching Accelerator-Releasing Compound

Compounds represented by formula (I) or (I') at page 5 of EP-A-310125 (particularly Compounds (60) and (61) at page 61); and compounds represented by formula (I) in claim 1 of JP-A-6-59411 (particularly, Compound (7) at page 7);

Ligand-Releasing Compound

Compounds represented by LIG-X described in claim 1 of U.S. Pat. No. 4,555,478 (particularly, compounds in column 12, lines 21 to 41);

Leuco Dye-Releasing Compound

Compounds 1 to 6 in columns 3 to 8 of U.S. Pat. No. 4,749,641;

Fluorescent Dye-Releasing Compound

Compounds represented by COUP-DYE in claim 1 of U.S. Pat. No. 4,774,181 (particularly, Compounds 1 to 11 in columns 7 to 10);

Development Accelerator- or Fogging Agent-Releasing Compound

Compounds represented by formula (1), (2) or (3) in column 3 of U.S. Pat. No. 4,656,123 (particularly Compound (I-22) in column 25) and Compound ExZK-2 at page 75, lines 36 to 38 of EP-A-450637;

Compound Which Releases A Group Capable of Becoming Dye First When Released

Compounds represented by formula (I) in claim 1 of U.S. Pat. No. 4,857,447 (particularly, Compounds Y-1 to Y-19 in columns 25 to 36).

Preferred additives other than couplers are described below.

Dispersion Medium of Oil-Soluble Organic Compound

Compounds P-3, P-5, P-16, P-19, P-25, P-30, P-42, P-49, P-54, P-55, P-66, P-81, P-85, P-86 and P-93 of JP-A-62-215272 (pages 140 to 144);

Latex for Impregnation of Oil-Soluble Organic Compound

Latexes described in U.S. Pat. No. 4,199,363;

Developing Agent Oxidation Product Scavenger

Compounds represented by formula (I) in column 2, lines 54 to 62 of U.S. Pat. No. 4,978,606 (particularly, Compounds I-(1), I-(2), I-(6) and I-(12) (columns 4 to 5)) and compounds represented by any one of the formulae in column 2, lines 5 to 10 of U.S. Pat. No. 4,923,787 (particularly, Compound 1 (column 3));

Stain Inhibitor

Compounds represented by formula (I), (II) or (III) at page 4, lines 30 to 33 of EP-A-298321 (particularly, Compounds I-47, I-72, III-1 and III-27 (pages 24 to 48));

Discoloration Inhibitor

Compounds A-6, A-7, A-20, A-21, A-23, A-24, A-25, A-26, A-30, A-37, A-40, A-42, A-48, A-63, A-90, A-92, A-94 and A-164 of EP-A-298321 (pages 69 to 118), Compounds II-1 to III-23 in columns 25 to 38 of U.S. Pat. No. 5,122,444 (particularly, Compound III-10), Compounds I-1 to III-4 at pages 8 to 12 of EP-A-471347 (particularly, Compound II-2) and Compounds A-1 to A-48 in columns 32 to 40 of U.S. Pat. No. 5,139,931 (particularly, Compounds A-39 and A-42);

Material Which Reduces Use Amount of Coloration Reinforcing Agent or Color Mixing Inhibitor Compounds I-1 to II-15 at pages 5 to 24 of EP-A-411324 (particularly, Compound I-46);

Formalin Scavenger

Compounds SCV-1 to SCV-28 at pages 24 to 29 of EP-A-477932 (particularly Compound SCV-8);

Hardening Agent

Compounds H-1, H-4, H-6, H-8 and H-14 at page 17 of JP-A-1-214845, compounds (Compounds H-1 to H-54) represented by any one of formulae (VII) to (XII) in columns 13 to 23 of U.S. Pat. No. 4,618,573, compounds (Compounds H-1 to H-76) represented by formula (6) at page 8, right lower column of JP-A-2-214852 (particularly, Compound H-14) and compounds described in claim 1 of U.S. Pat. No. 3,325,287;

Development Inhibitor Precursor

Compounds P-24, P-37 and P-39 of JP-A-62-168139 (pages 6 and 7) and compounds described in claim 1 of U.S. Pat. No. 5,019,492 (particularly, Compounds 28 and 29 in column 7);

Antiseptic, Antifungal

Compounds I-1 to III-43 in columns 3 to 15 of U.S. Pat. No. 4,923,790 (particularly, Compounds II-1, II-9, II-10, II-18 and III-25);

Stabilizer, Antifoggant

Compounds I-1 to (14) in columns 6 to 16 of U.S. Pat. No. 4,923,793 (particularly, Compounds I-1, I-60, (2) and (13)) and Compounds 1 to 65 in columns 25 to 32 of U.S. Pat. No. 4,952,483 (particularly, Compound 36);

Chemical Sensitizer

Triphenylphosphine, selenide and Compound 50 of JP-A-5-40324;

Dye

Compounds a-1 to b-20 at pages 15 to 18 (particularly, Compounds a-1, a-12, a-18, a-27, a-35, a-36 and b-5) and Compounds V-1 to V-23 at pages 27 to 29 (particularly, Compound V-1) of JP-A-3-156450, Compounds F-I-1 to F-II-43 at pages 33 to 55 of EP-A-445627 (particularly, Compounds F-I-11 and F-II-8), Compounds III-1 to III-36 at pages 17 to 28 of EP-A-457153 (particularly, Compounds III-1 and III-3), fine crystal dispersion products of Dye-1 to Dye-124 at pages 8 to 26 of WO88/04794, Compounds 1 to 22 at pages 6 to 11 of EP-A-319999 (particularly, Compound 1), Compounds D-1 to D-87 (pages 3 to 28) represented by formula (1), (2) or (3) of EP-A-519306, Compounds 1 to 22 (columns 3 to 10) represented by formula (I) of U.S. Pat. No. 4,268,622 and Compounds (1) to (31) (columns 2 to 9) represented by formula (I) of U.S. Pat. No. 4,923,788;

UV Absorbent

Compounds (18b) to (18r) and Compounds 101 to 427 (pages 6 to 9) represented by formula (1) of JP-A-46-3335, Compounds (3) to (66) (pages 10 to 44) represented by formula (I) and Compounds HBT-1 to HBT-10 (page 14) represented by formula (III), of EP-A-520938, and Compounds (1) to (31) (columns 2 to 9) represented by formula (1) of EP-A-521823.

The color negative film of the present invention may be a film unit with a lens described in JP-B-2-32615 and JP-B-U-3-39784 (the term "JP-B-U" as used herein means an "examined Japanese utility model publication"). Examples of suitable supports which can be used in the present invention include those described in RD, No. 17643, page 28, ibid., No. 18716, from page 647, right column to page 648, left column, and ibid., No. 307105, page 879, but a polyester support is preferably used.

The color negative film for use in the present invention preferably has a magnetic recording layer. The magnetic recording layer for use in the present invention is descried below. The magnetic recording layer used in the present invention is provided by coating an aqueous or organic solvent-base coating solution prepared by dispersing magnetic particles in a binder, on a support. The magnetic particle includes ferromagnetic iron oxide (e.g., $\gamma Fe_2O_3$), Co-doped $\gamma Fe_2O_3$, Co-doped magnetite, Co-containing magnetite, ferromagnetic chromium dioxide, ferromagnetic metal, ferromagnetic alloy, hexagonal Ba ferrite, Sr ferrite, Pb ferrite and Ca ferrite. Among these, Co-doped ferromagnetic iron oxide such as Co-doped $\gamma Fe_2O_3$ is preferred. The form of the magnetic particle may be any of acicular, rice grain-like, spherical, cubic and platy forms. The specific surface area as $S_{BET}$ is preferably 20 $m^2/g$ or more, more preferably 30 $m^2/g$ or more. The saturation magnetization ($\sigma s$) of the ferromagnetic material is preferably from $3.0\times10^4$ to $3.0\times10^5$ A/m, more preferably from $4.0\times10^4$ to $2.5\times10^5$ A/m. The ferromagnetic particle may be subjected to surface treatment with silica and/or alumina or an organic material. Further, the ferromagnetic particle may be subjected to surface treatment with a silane coupling agent or a titanium coupling agent as described in JP-A-6-161032. Also, a magnetic particle having coated on the surface thereof an inorganic or organic material described in JP-A-4-259911 and JP-A-5-81652 may be used.

The binder for use in the magnetic particle includes a thermoplastic resin, a thermosetting resin, a radiation-curable resin, a reactive resin, an acid, alkali or biodegradable polymer, a natural polymer (e.g., cellulose derivative, saccharide derivative) and a mixture thereof described in JP-A-4-219569. The above-described resin has a Tg of from −40° C. to 300° C. and a weight average molecular weight of from 2,000 to 1,000,000. Examples of the resin include vinyl-base copolymers, cellulose derivatives such as cellulose diacetate, cellulose triacetate, cellulose acetate propionate, cellulose acetate butyrate and cellulose tripropionate, acrylic resins and polyvinyl acetal resins, and gelatin is also preferably used. Among these, cellulose di(tri)acetate is preferred. The binder may be cured by adding thereto an epoxy-base, aziridine-base or isocyanate-base cross-linking agent. Examples of the isocyanate-base cross-linking agent include isocyanates such as tolylenediisocyanate, 4,4'-diphenylmethane diisocyanate, hexamethylene diisocyanate and xylylene diisocyanate, reaction products of this isocyanate with polyalcohol (e.g., a reaction product of 3 mole of tolylene diisocyanate with 1 mole of trimethylolpropane), and polyisocyanates produced by condensation of the isocyanate, which are described, for example, in JP-A-6-59357.

The magnetic recording layer may be designed to have additional functions such as improvement of lubricity, control of curl, electrostatic charge prevention, prevention of adhesion or head abrasion, or other functional layers may be provided to undertake these functions. At least one or more of the particles is preferably an abrasive as an aspheric inorganic particle having a Mohs' hardness of 5 or more. The composition of the aspheric inorganic particle is preferably an oxide such as aluminum oxide, chromium oxide, silicon dioxide or titanium dioxide, a carbide such as silicon carbide or titanium carbide, or a fine particle of diamond or the like. The abrasive may be subjected to surface treatment with a silane coupling agent or a titanium coupling agent. The particles may be added to a magnetic recording layer or may be overcoated on the magnetic recording layer (for example, as a protective layer or a lubricant layer). The binder used here may be one described above and it is preferably the same as the binder in the magnetic recording layer. The light-sensitive material having a magnetic recording layer is described in U.S. Pat. Nos. 5,336,589, 5,250,404, 5,229,259 and 5,215,874 and EP-A-466130.

The polyester support for use in the present invention is described below, however, the details thereof including the light-sensitive material, the processing, the cartridge and the working examples are described in *JIII Journal of Technical Disclosure* No. 94-6023, Japan Institute of Invention and Innovation (Mar. 15, 1994). The polyester for use in the present invention essentially consists of a diol and an aromatic dicarboxylic acid. Examples of the aromatic dicarboxylic acid include 2,6-naphthalenedicarboxylic acid, 1,5-naphthalenedicarboxylic acid, 1,4-naphthalenedicarboxylic acid, 2,7-naphthalenedicarboxylic acid, terephthalic acid, isophthalic acid and phthalic acid, and examples of the diol include diethylene glycol, triethylene glycol, cyclohexanedimethanol, bisphenol A and bisphenol. The polymer polymerized from these includes homopolymers such as polyethylene terephthalate, polyethylene naphthalate and polycyclohexanedimethanol terephthalate. Among these, preferred is a polyester containing from 50 to 100 mole % of 2,6-naphthalenedicarboxylic acid, and more preferred is polyethylene 2,6-naphthalate. The average molecular weight is from about 5,000 to 200,000. The polyester for use in the present invention has a Tg of 50° C. or higher, preferably 90° C. or higher.

In the present invention, an antistatic agent is preferably used. Examples of the antistatic agent includes polymers containing a carboxylic acid, a carboxylate or a sulfonate, cationic polymers and ionic surface active agent compounds. Most preferred antistatic agents are fine particles of at least one crystalline metal oxide having a volume resistivity of $10^7$ Ω.cm or less, preferably $10^5$ Ω.cm or less and a particle size of from 0.001 to 1.0 μm, selected from ZnO, $TiO_2$, $SnO_2$, $Al_2O_3$, $In_2O_3$, $SiO_2$, MgO, BaO, $MoO_3$ and $V_2O_5$, or a composite oxide thereof (e.g., Sb, P, B, In, S, Si, C), and fine particles of a sol-like metal oxide or a composite oxide thereof. The content of the antistatic agent in the light-sensitive material is preferably from 5 to 500 $mg/m^2$, more preferably from 10 to 350 $mg/m^2$. The ratio of the electrically conductive crystalline oxide or a composite oxide thereof to the binder is preferably from 1/300 to 100/1, more preferably from 1/100 to 100/5.

The light-sensitive material of the present invention preferably has sliding property. The sliding agent-containing layer is preferably provided on both the light-sensitive layer surface and the back surface. The sliding property is preferably, in terms of a coefficient of dynamic friction, from 0.01 to 0.25. This value is determined by transporting the light-sensitive material at a speed of 60 cm/min (25° C., 60% RH) against a stainless steel ball having a diameter of 5 mm. In this evaluation, even when the other party is changed from the back surface to the light-sensitive layer surface, a value almost on the same level is obtained. The sliding agent which can be used in the present invention includes polyorganosiloxane, a higher fatty acid amide, a higher fatty acid metal salt and an ester of a higher fatty acid with a higher alcohol. The layer to which the sliding agent is added is preferably an outermost layer of the emulsion layers or a back layer.

V. Supplemental Explanation of Development Processing for Use in the Present Invention The present invention is described in the forgoing by referring to the international general-purpose common processing such as CN16 processing and C41 processing as the standard development processing, however, the development processing to which the image formation method of the present invention can be applied is not necessarily limited to these international common processings. A color development processing to which the present invention is applied is additionally described below.

The color development tank solution or color developer replenishing solution for use in the development processing of the color negative film of the present invention is an alkaline aqueous solution mainly comprising an aromatic primary amine color developing agent. As the color developing agent, an aminophenol-base compound is useful but a p-phenylenediamine-base compound is preferably used and representative examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, 4-amino-3-propyl-N-(4-hydroxybutyl)aniline, and a sulfate, a hydrochloride or a p-toluenesulfonate thereof. Among these, preferred are 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline, and a hydrochloride, a p-toluenesulfonate or a sulfate thereof. These compounds may be used in combination of two or more depending on the purpose.

The amount of an aromatic primary amine developing agent used is desirably from 0.0002 to 0.2 mole, more desirably from 0.001 to 0.1 mole, per liter of color developer.

The color developer usually contains a pH buffering agent such as a carbonate, borate or phosphate of an alkali metal or a 5-sulfosalicylate, or a development inhibitor or antifoggant such as a chloride salt, a bromide salt, an iodide salt, a benzimidazole, a benzothiazole and a mercapto compound. The color developer may also contain various blending materials, if desired, and representative examples thereof include a preservative such as hydroxylamine, diethylhydroxylamine, hydroxylamines represented by formula (I) of JP-A-3-144446, sulfite, hydrazines (e.g., N,N-biscarboxymethylhydrazine), phenylsemicarbazides, triethanolamine and catecholsulfonic acids; an organic solvent such as ethylene glycol and diethylene glycol; a development accelerator such as benzyl alcohol, polyethylene glycol, quaternary ammonium salts and amines; a dye-forming coupler; a competing coupler; an auxiliary developing agent such as 1-phenyl-3-pyrazolidone; a tackifying agent; and various chelating agents including aminopolycarboxylic acid, aminopolyphosphonic acid, alkylphosphonic acid and phosphonocarboxylic acid, such as ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid), and a salt thereof.

Among these blending materials, the preservative is preferably an unsubstituted hydroxylamine or a substituted hydroxylamine, more preferably diethylhydroxylamine, monomethylhydroxylamine or a hydroxylamine having an alkyl group substituted with a water-soluble group such as a sulfo group, a carboxyl group or a hydroxyl group, as the substituent, and most preferably N,N-bis(2-sulfoethyl) hydroxylamine or an alkali metal salt thereof.

The chelating agent is preferably a compound having biodegradability, and examples thereof include the chelating agents described in JP-A-63-146998, JP-A-63-199295, JP-A-63-267750, JP-A-63-267751, JP-A-2-229146, JP-A-3-186841, German Patent No. 3,739,610 and European Patent No. 468,325.

The processing solution in the replenishing tank for the color developer is preferably shielded by a liquid agent such as a high boiling point organic solvent, to reduce the contact area with air. The liquid shielding agent is most preferably liquid paraffin.

During the development using a color developer as described above, it is desirable that the processing temperature be from 20° C. to 55° C., preferably from 30° C. to 55° C., and the processing time be from 30 seconds to 4 minutes, preferably from 45 seconds to 3 minutes and 20 seconds, particularly preferably from 60 seconds to 3 minutes and 15 seconds.

In this processing method, the light-sensitive material is desilvered after the color development. The desilvering step is described in detail below.

The desilvering step generally comprises a bleaching step, a bleach-fixing step and a fixing step, and various series of steps may be used. Specific examples thereof are described below, but the present invention is by no means limited thereto.

| | |
|---|---|
| (Step 1) | bleach-fixing |
| (Step 2) | bleaching - bleach-fixing |
| (Step 3) | bleaching - bleach-fixing - fixing |
| (Step 4) | fixing - bleach-fixing |
| (Step 5) | bleaching - fixing |

Each processing bath may be divided into two or more baths, if desired, or may be replenished by the cascade method.

The bleaching agent for use in the processing solution having bleaching ability is aminopolycarboxylic acid iron (III) complex, persulfate, bromate, hydrogen peroxide or red prussiate, most preferably aminopolycarboxylic acid iron (III) complex.

The ferric complex salt for use in this processing method may be added and dissolved as an iron complex salt prepared by previously performing complexing, or a complex-forming compound and a ferric salt (e.g., ferric sulfate, ferric chloride, ferric bromide, iron(III) nitrate, ammonium iron (III) sulfate) are allowed to be present in the solution having bleaching ability to form a complex in the solution.

The complex-forming compound may be added slightly in excess of the amount necessary for the complex formation with the ferric ion, and when the compound is added in excess, the excess by from 0.01 to 10% is usually preferred.

Examples of the compound which forms a ferric complex salt in the solution having bleaching ability include ethylenediaminetetraacetic acid (EDTA), 1,3-propanediaminetetraacetic acid (1,3-PDTA), diethylenetriaminepentaacetic acid, 1,2-cyclohexanediaminetetraacetic acid, iminodiacetic acid, methyliminodiacetic acid, N-(2-acetamido)iminodiacetic acid, nitrilotriacetic acid, N-(2-carboxyethyl)iminodiacetic acid, N-(2-carboxymethyl) iminodipropionic acid, β-alaninediacetic acid, α-methylnitrilotriacetic acid, 1,4-diaminobutanetetraacetic acid, glycol ether diaminetetraacetic acid, N-(2-carboxyphenyl)iminodiacetic acid, ethylenediamine-N-(2-carboxyphenyl)-N,N',N'-triacetic acid, ethylenediamine-N,N'-disuccinic acid, 1,3-diaminopropane-N,N'-disuccinic acid, ethylenediamine-N,N'-dimalonic acid and 1,3-diaminopropane-N,N'-dimalonic acid, however, the present invention is by no means limited thereto.

The concentration of the ferric complex salt in the processing solution having bleaching ability is suitably from 0.005 to 1.0 mole/l, preferably from 0.01 to 0.50 mole/l, more preferably from 0.02 to 0.30 mole/l.

The concentration of the ferric complex salt in the replenishing solution for the processing solution having bleaching ability is preferably from 0.005 to 2 mole/l, more preferably from 0.01 to 1.0 mole/l.

The bath having bleaching ability or a pre-bath thereof may use various compounds as the bleaching accelerator and, for example, compounds having a mercapto group or disulfide bond described in U.S. Pat. No. 3,893,858, German Patent 1,290,812, JP-A-53-95630 and *Research Disclosure*, No. 17129 (July, 1978), and thiourea-base compounds or halides such as iodine and bromine ions described in JP-B-45-8506, JP-A-52-20832, JP-A-53-32735 and U.S. Pat. No. 3,706,561 are preferred because of their excellent bleaching ability.

In addition, the bath having bleaching ability may contain a rehalogenating agent such as a bromide (e.g., potassium bromide, sodium bromide, ammonium bromide), a chloride (e.g., potassium chloride, sodium chloride, ammonium chloride) and an iodide (e.g., ammonium iodide). If desired, the bath having bleaching ability may contain one or more of inorganic acids and organic acids having a pH buffering ability and an alkali metal or ammonium salt thereof, such as borax, sodium metaborate, acetic acid, sodium acetate, sodium carbonate, potassium carbonate, phosphorous acid, phosphoric acid, sodium phosphate, citric acid, sodium citrate, tartaric acid, malonic acid, succinic acid and glutaric acid, and may further contain an anti-corrosion agent such as ammonium nitrate and guanidine.

The bath having bleaching ability may additionally contain a whitening agent, a defoaming agent, a surface active agent and an organic solvent such as polyvinylpyrrolidone and methanol.

The fixing agent component used in the bleach-fixing solution or fixing solution is preferably a thiosulfate. Examples of the thiosulfate include sodium thiosulfate, potassium thiosulfate and ammonium thiosulfate. Other known fixing agents may also be used and examples thereof include thiocyanates such as sodium thiocyanate and ammonium thiocyanate, and water-soluble silver halide dissolving agents such as a thioether compound (e.g., ethylenebisthioglycolic acid, 3,6-dithia-1,8-octanediol), a mesoionic compound and a thiourea. In the present invention, a thiosulfate is preferred, and ammonium thiosulfate, potassium thiosulfate and sodium thiosulfate are more preferred. The total amount of the fixing agent is preferably from 0.3 to 3.0 mole/l, more preferably from 0.5 to 2.0 mole/l.

The bleach-fixing solution or fixing solution preferably contains a sulfite (or bisulfite, metabisulfite) as the preservative, and the sulfite is preferably added in an amount of from 0.03 to 0.5 mole/l, more preferably from 0.05 to 0.3 mole/l.

In addition to the sulfite ion-releasing compound referred to above as the preservative, such as sulfite (e.g., sodium sulfite, potassium sulfite, ammonium sulfite), bisulfite (e.g., ammonium bisulfite, sodium bisulfite, potassium bisulfite), metabisulfite (e.g., potassium metabisulfite, sodium metabisulfite, ammonium metabisulfite), the bleach-fixing solution or fixing solution may contain an aldehyde (e.g., benzaldehyde, acetaldehyde), a ketone (e.g., acetone), an ascorbic acid, a hydroxylamine, a benzenesulfinic acid or an alkylsulfinic acid, if desired. In particular, a benzenesulfinic acid, p-methylbenzenesulfinic acid and a p-aminobenzenesulfinic acid are preferred. The amount added is preferably on the order of from 0.005 to 0.3 mole/l.

Furthermore, the bleaching solution, bleach-fixing solution or fixing solution may contain a buffering agent, a whitening agent, a chelating agent, a defoaming agent and an antifungal, if desired.

The pH region of the bleaching solution, bleach-fixing solution or fixing solution is preferably from 4 to 8, more preferably from 4.5 to 6.5.

The replenishing amount to the bleaching solution, bleach-fixing solution or fixing solution is from 50 to 2,000 ml per $m^2$ of the light-sensitive material. The overflow solution from the water washing or stabilization bath as a post bath may also be used as the replenishing solution, if desired.

The processing temperature of the bleaching, bleach-fix and fixing baths each is from 20 to 50° C., preferably from 30 to 45° C. The processing time thereof is from 10 seconds to 3 minutes, preferably from 20 seconds to 2 minutes. The present invention can achieve remarkable effects in the rapid processing where the total of the desilvering time and the washing (stabilizing) time is from about 30 seconds to about 3 minutes and 30 seconds.

The processing solution having bleaching ability is particularly preferably aerated during the processing so that the photographic capability can be very stably maintained. The aeration can be performed using a means known in the art and for example, air is blown into the processing solution having bleaching ability or air is absorbed thereinto using an executer.

The aeration may be performed directly in the processing tank, however, in order to prevent the contamination by the mixing of other solutions, the aeration is preferably performed in the stock tank.

The blowing of air is preferably performed by releasing air into the solution through a diffusion tube having fine pores. Such a diffusion tube is widely used, for example, in an aeration tank for the activated sludge processing. With respect to the aeration, the matters described in *Z*-121. *Using Process C*-41, 3rd edition, pages BL-1 to BL-2, published by Eastman Kodak Co. (1982) may be used. In the processing using the processing solution having bleaching ability of the present invention, stirring is preferably intensified and for the intensification, the contents described in JP-A-3-33847, page 8, right upper column, line 6 to left lower column, line 2 can be used as it is.

In the development processing device of the present invention, the aeration is preferably performed in the circulation system or stock tank.

The light-sensitive material is generally subjected to water washing and/or stabilization after the desilvering process.

In the water washing and/or stabilization step, the processing condition needs to be controlled in such a manner that the concentration of thiosulfate remaining in the processed light-sensitive material becomes from 30 to 1,500 $\mu$mole/m$^2$.

More specifically, the concentration of the thiosulfate in the final bath is preferably adjusted to approximately from 0.001 to 0.04 mole/l. To this effect, thiosulfate in the above-described concentration may be added to the final bath or when thiosulfate is used as the fixing component, the replenishing amount in the water washing or stabilization step subsequent to the desilvering step is preferably reduced so that the final bath can have the above-described concentration.

Although the replenishing amount varies depending on the concentration of thiosulfate at the fixing step or the number of baths in the water washing step or stabilization step, it is approximately from 100 to 1,000 ml, preferably from 130 to 700 ml, per m$^2$ of the light-sensitive material.

With respect to the amount of washing water in the water washing step, the relationship between the number of water washing tanks and the amount of water in a multi-stage countercurrent system can be obtained according to the method described in *Journal of the Society of Motion Picture and Television Engineers*, Vol. 64, pp. 248–253 (May, 1955). According to the multi-stage countercurrent system described in the above-described publication, the amount of washing water may be greatly reduced but due to the increase in the residence time of water in the tank, a problem is caused such that bacteria proliferate and the floats generated adhere to the light-sensitive material.

In order to solve such a problem in the processing of a color light-sensitive material, a method of reducing calcium ion or magnesium ion described in JP-A-62-288838 can be very effectively used. Further, isothiazolone compounds and thiabendazoles described in JP-A-57-8542, chlorine-based bactericides such as sodium chlorinated isocyanurate, and bactericides such as benzotriazoles, described in Hiroshi Horiguchi, *Bokin, Bobai-Zai no Kagaku* (*Chemistry of Bactericide and Antifungal*), Sankyo Shuppan (1986), *Biseibutsu no Mekkin, Sakkin, Bobai-Gijutsu* (*Germicidal, Bactericidal and Antifungal Technology of Microorganism*) compiled by Eisei Gijutsu Kai, issued by Kogyo Gijutsu Kai (1982), and *Bokin-Bobai Zai Jiten* (*Lexicon of Bactericide and Antifungal*) compiled by Nippon Bokin Bobai Gakkai (1986) may also be used.

The pH of the final bath in the processing of a light-sensitive material may be freely selected, however, it is preferably from 3.5 to 8, more preferably from 4 to 7. This pH is preferably set to reflect on the layer pH of the processed light-sensitive material and for this purpose, various buffering agents may be used. Specific examples of the buffering agent include acetic acid, malonic acid, succinic acid, malic acid, maleic acid and phthalic acid.

The temperature of washing water and the washing time can be set variously depending on the photographic characteristics and the intended use of a photographic material to be processed, but they are generally chosen so that the washing time ranges from 20 seconds to 5 minutes at temperatures of 20 to 45° C., preferably from 30 seconds to 3 minutes at temperatures of 25 to 40° C. In particular, the present invention can achieve remarkable effects under the condition that the total of the processing time in the previous desilvering process and the processing time in this washing (or stabilizing) process is from 30 seconds to 3 minutes and 30 seconds, preferably from 60 seconds to 2 minutes and 30 seconds. Also, the present photographic materials can be processed with a stabilizer directly after the desilvering process without undergoing any washing step. To this stabilization processing, any of the known methods described in JP-A-57-8543, JP-A-58-14834 and JP-A-60-220345 can be applied.

The stabilizing solution contains a compound which stabilizes the dye image, for example, a benzaldehyde such as formalin or m-hydroxybenzaldehyde, a formaldehyde bisulfite addition product, a hexamethylenetetramine or a compound thereof, a hexahydrotriazine or a compound thereof, a dimethylolurea, a N-methylol compound such as N-methylolpyrazole, an organic acid or a pH buffering agent. The amount of the compound added is preferably from 0.001 to 0.02 mole per l of the stabilizing solution, however, the concentration of free formaldehyde in the stabilizing solution is preferably lower because splashing of formaldehyde gas is reduced. In this point of view, preferred examples of the dye image stabilizer are N-methylolazoles such as m-hydroxybenzaldehyde, hexamethylene tetramine and N-methylolpyrazole described in JP-A-4-270344, and azolylmethylamines such as N,N'-bis(1,2,4-triazol-1-ylmethyl)piperazine described in JP-A-4-313753. Particularly, a combination use of an azole such as 1,2,4-triazole described in JP-A-4-359249 (corresponding to EP-A-519190) with azolylmethylamine or a compound thereof such as 1,4-bis(1,2,4-triazolyl-1-ylmethyl) piperazine is preferred because high image stability is obtained and the formaldehyde vapor pressure is low. Furthermore, if desired, the stabilizing solution preferably contains an ammonium compound such as ammonium chloride and ammonium sulfite, a metal compound such as Bi and Al, a whitening agent, a hardening agent, an alkanolamine described in U.S. Pat. No. 4,786,583, and a preservative which can be contained in the above-described fixing solution or bleach-fixing solution, such as a sulfinic acid compound described JP-A-1-31051.

The washing water and/or stabilizing solution may contain various surface active agents so as to prevent water droplet unevenness at the drying of a processed light-sensitive material. In particular, a nonionic surface active agent is preferably used and an alkylphenol-ethylene oxide adduct is more preferred. The alkylphenol is more preferably octyl, nonyl, dodecyl or dinonylphenol, and the addition molar number of the ethylene oxide is preferably from 8 to 14. Also, a silicone-base surface active agent having a high defoaming effect is preferably used.

The washing water and/or stabilizing solution preferably contains various chelating agents. Preferred examples of the chelating agent include aminopolycarboxylic acids such as ethylenediaminetetraacetic acid and diethylenetriaminepentaacetic acid, organic phosphonic acids such as 1-hydroxyethylidene-1,1-diphosphonic acid, N,N,N'-trimethylenephosphonic acid and diethylenetriamine-N,N,N',N'-tetramethylenesulfonic acid, and hydrolysates of a maleic anhydride polymer described in EP-A-345172.

The present invention will now be illustrated in more detail by reference to the following examples.

EXAMPLE 1

1. Color Negative Film

The surface of a cellulose triacetate film support was provided with an undercoat, and further coated successively with various photographic constituent layers having the following compositions to prepare a multilayer color photographic material for picture-taking use.

(Compositions of Constituent Layers)

The main ingredients used in each constituent layers are classified as follows:

| | |
|---|---|
| ExC: Cyan coupler | UV: Ultraviolet absorbent |
| ExM: Magenta coupler | HBS: High boiling point organic solvent |
| ExY: Yellow coupler | |
| ExS: Sensitizing dye | H: Gelatin hardener |

($g/m^2$) of the ingredient corresponding thereto. As for the silver halide emulsion, the figure represents the coverage based on silver. With respect to the sensitizing dye, on the other hand, the figure represents the coverage expressed in mole number thereof per mole of the silver halide in the same layer.

<Sample for Comparison (Sample No. 101)>

This sample is a color negative film of substantially the same type as all-purpose color negative films which are on the market and developed in photofinishing laboratories scattered all over the world, and therefore the mask density (Dmin) and the gradation thereof are equivalent to those of all-purpose films.

| | | |
|---|---|---|
| First layer (antihalation layer) | | |
| Black colloidal silver | silver | 0.09 |
| Gelatin | | 1.60 |
| ExM-1 | | 0.12 |
| ExF-1 | | $2.0 \times 10^{-3}$ |
| Solid disperse dye ExF-2 | | 0.030 |
| Solid disperse dye ExF-3 | | 0.040 |
| HBS-1 | | 0.15 |
| HBS-2 | | 0.02 |
| Second layer (interlayer) | | |
| Silver iodobromide emulsion M | silver | 0.065 |
| ExC-2 | | 0.04 |
| Polyethylacrylate latex | | 0.20 |
| Gelatin | | 1.04 |

-continued

| | | |
|---|---|---|
| Third layer (low-sensitivity red-sensitive emulsion layer) | | |
| Silver iodobromide Emulsion A | silver | 0.25 |
| Silver iodobromide Emulsion B | silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-3 | | 0.030 |
| ExC-4 | | 0.10 |
| ExC-5 | | 0.020 |
| ExC-6 | | 0.010 |
| Cpd-2 | | 0.025 |
| HBS-1 | | 0.10 |
| Gelatin | | 0.87 |
| Fourth layer (medium-sensitivity red-sensitive emulsion layer) | | |
| Silver iodobrornide Ernulsion C | silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.015 |
| ExC-6 | | 0.0070 |
| Cpd-2 | | 0.023 |
| HBS-1 | | 0.10 |
| Gelatin | | 0.75 |
| Fifth layer (high-sensitivity red-sensitive emulsion layer) | | |
| Silver iodobromide Emulsion D | silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.10 |
| ExC-3 | | 0.045 |
| ExC-6 | | 0.020 |
| ExC-7 | | 0.010 |
| Cpd-2 | | 0.050 |
| HBS-1 | | 0.22 |
| HBS-2 | | 0.050 |
| Gelatin | | 1.10 |
| Sixth layer (interlayer) | | |
| Cpd-1 | | 0.090 |
| Solid disperse dye ExF-4 | | 0.030 |
| HBS-1 | | 0.050 |
| Polyethylacrylate latex | | 0.15 |
| Gelatin | | 1.10 |
| Seventh layer (low-sensitivity green-sensitive emulsion layer) | | |
| Silver iodobromide Emulsion E | silver | 0.15 |
| Silver iodobromide Emulsion F | siiver | 0.10 |
| Silver iodobromide Emulsion G | silver | 0.10 |
| ExS-4 | | $3.0 \times 10^{-5}$ |
| ExS-5 | | $2.1 \times 10^{-4}$ |
| ExS-6 | | $8.0 \times 10^{-4}$ |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |
| Eighth layer (medium-sensitivity green-sensitive emulsion layer) | | |
| Silver iodobromide Emulsion H | silver | 0.80 |
| ExS-4 | | $3.2 \times 10^{-5}$ |
| ExS-5 | | $2.2 \times 10^{-4}$ |
| ExS-6 | | $8.4 \times 10^{-4}$ |
| ExC-8 | | 0.010 |
| ExM-2 | | 0.10 |
| ExM-3 | | 0.025 |

-continued

| | | |
|---|---|---|
| ExY-1 | | 0.018 |
| ExY-4 | | 0.010 |
| ExY-5 | | 0.040 |
| HBS-1 | | 0.13 |
| HBS-3 | | $4.0 \times 10^{-3}$ |
| Gelatin | | 0.80 |
| Ninth layer (high-sensitivity green-sensitive emulsion layer) | | |
| Silver iodobromide Emulsion I | silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.10 |
| ExM-1 | | 0.020 |
| ExM-4. | | 0.025 |
| ExM-5 | | 0.040 |
| Cpd-3 | | 0.040 |
| HBS-1 | | 0.25 |
| Polyethylacrylate latex | | 0.15 |
| Gelatin | | 1.33 |
| Tenth layer (yellow filter layer) | | |
| Yellow colloidal silver | silver | 0.015 |
| Cpd-1 | | 0.16 |
| Solid disperse dye ExF-5 | | 0.060 |
| Solid disperse dye ExF-6 | | 0.060 |
| Oil-soluble dye ExF-7 | | 0.010 |
| HBS-1 | | 0.60 |
| Gelatin | | 0.60 |
| Eleventh layer (low-sensitivity blue-sensitive emulsion layer) | | |
| Silver iodobromide Emulsion J | silver | 0.09 |
| Silver iodobromide Emulsion K | silver | 0.09 |
| ExS-7 | | $8.6 \times 10^{-4}$ |
| ExC-8 | | $7.0 \times 10^{-3}$ |
| ExY-1 | | 0.050 |
| ExY-2 | | 0.22 |
| ExY-3 | | 0.50 |
| ExY-4 | | 0.020 |
| Cpd-2 | | 0.10 |
| Cpd-3 | | $4.0 \times 10^{-3}$ |

-continued

| | | |
|---|---|---|
| HBS-1 | | 0.28 |
| Gelatin | | 1.20 |
| Twelfth layer (high-sensitivity blue-sensitive emulsion layer) | | |
| Silver iodobromide emulsion L | silver | 1.00 |
| ExS-7 | | $4.0 \times 10^{-4}$ |
| ExY-2 | | 0.10 |
| ExY-3 | | 0.10 |
| ExY-4 | | 0.010 |
| Cpd-2 | | 0.10 |
| Cpd-3 | | $1.0 \times 10^{-3}$ |
| HBS-1 | | 0.070 |
| Gelatin | | 0.70 |
| Thirteenth layer (first protective layer) | | |
| UV-1 | | 0.19 |
| UV-2 | | 0.075 |
| UV-3 | | 0.065 |
| HBS-1 | | $5.0 \times 10^{-2}$ |
| HBS-4 | | $5.0 \times 10^{-2}$ |
| Gelatin | | 1.8 |
| Fourteenth layer (second protective.layer) | | |
| Silver iodobromide emulsion M | silver | 0.10 |
| H-1 | | 0.40 |
| B-1 (diameter: 1.7 μm) | | $5.0 \times 10^{-2}$ |
| B-2 (diameter: 1.7 μm) | | 0.15 |
| B-3 | | 0.05 |
| S-1 | | 0.20 |
| Gelatin | | 0.70 |

In order to improve the keeping quality, processing suitability, pressure resistance, antimold and antibacterial properties, antistatic properties and coating suitability, W-1 to W-3, B-4 to B-6, F-1 to F-17, and iron, lead, gold, platinum, palladium, iridium and rhodium salts were added to each layer in their respectively proper amounts.

The characteristics of the silver iodobromide emulsions used in the foregoing layers are summarized in Table 2.

TABLE 2

| Emulsion | Average AgI content (%) | Variation coefficient (%) with respect to AgI contents among grains | Average diameter (equivalent-sphere diameter) (μm) | Variation coefficient (%) with respect to grain diameter | Projected area diameter (equivalent-circle diameter) (μm) | Diameter/thickness ratio |
|---|---|---|---|---|---|---|
| A | 1.7 | 10 | 0.46 | 15 | 0.56 | 5.5 |
| B | 3.5 | 15 | 0.57 | 20 | 0.78 | 4.0 |
| C | 8.9 | 25 | 0.66 | 25 | 0.87 | 5.8 |
| D | 8.9 | 18 | 0.84 | 26 | 1.03 | 3.7 |
| E | 1.7 | 10 | 0.46 | 15 | 0.56 | 5.5 |
| F | 3.5 | 15 | o.57 | 20 | 0.78 | 4.o |
| G | 8.8 | 25 | 0.61 | 23 | 0.77 | 4.4 |
| H | 8.8 | 25 | 0.61 | 23 | 0.77 | 4.4 |
| I | 8.9 | 18 | 0.84 | 26 | 1.03 | 3.7 |
| J | 1.7 | 10 | 0.46 | 15 | 0.50 | 4.2 |
| K | 8.8 | 18 | 0.64 | 23 | 0.85 | 5.2 |
| L | 14.0 | 25 | 1.28 | 26 | 1.46 | 3.5 |
| M | 1.0 | — | 0.07 | 15 | — | 1 |

(1) Emulsions J to L each underwent the reduction sensitization using thiourea dioxide and thiosulfonic acid at the time of grain formation in accordance with Examples of JP-A-2-191938.

(2) Emulsions A to I each underwent the gold sensitization, the sulfur sensitization and the selenium sensitization in the presence of the spectral sensitizing dyes used in their corresponding light-sensitive layer and sodium thiocyanate in accordance with Examples of JP-A-3-237450.

(3) In the formation of tabular grains, low molecular weight gelatin was used in accordance with Examples of JP-A-1-158426.

(4) With respect to the tabular grains, the dislocation lines as described in JP-A-3-237450 were observed under a high-pressure electron microscope.

(5) Emulsion L was the emulsion comprising the double-structure grains having an iodide-rich core inside thereof as described in JP-A-60-143331.

(Preparation of Organic Solid Disperse Dye Dispersion)

ExF-2 illustrated below was dispersed in the following manner: In a pot mill having a volume of 700 ml, 21.7 ml of water, 3 ml of a 5% aqueous solution of sodium p-octylphenoxyethoxyethoxyethanesulfonate and 0.5 g of a 5% aqueous solution of p-octylphenoxypolyoxyethylene ether (polymerization degree: 10) were placed, and thereto 5.0 g of a dye ExF-2 and 500 ml of zirconium beads (diameter: 1 mm) were added. The contents in the pot mill were dispersed for 2 hours with a BO type vibration ball mill made by Chuo Koki Co., Ltd. After dispersion, the contents were taken out of the pot mill, and thereto 8 g of a 12.5% of aqueous gelatin solution was added. Then, the admixture was filtered to remove the beads. Thus, a gelatin dispersion of the dye was obtained. The average diameter of fine dye grains was 0.44 μm.

In the similar manner to the above, solid dispersions of ExF-3, ExF-4 and ExF-6 were each prepared, and their average diameters of fine dye grains were 0.24 μm, 0.45 μm and 0.52 μm respectively. On the other hand, the dye ExF-5 was dispersed using the microprecipitation method described in Example 1 of EP-A-0549489, and the average grain diameter thereof was 0.06 μm.

The structures of the ingredients used in the foregoing constituent layers are illustrated below:

ExC-1

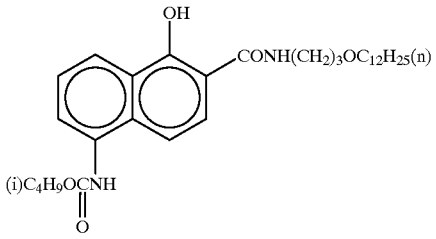

ExC-2

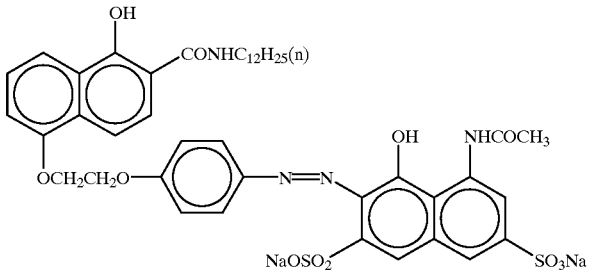

ExC-3

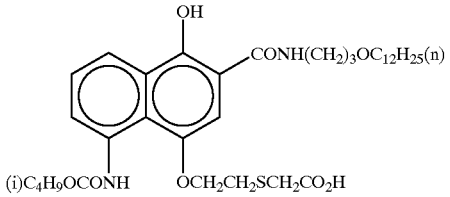

ExC-4

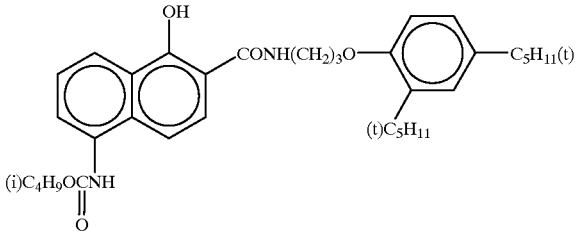

ExC-5

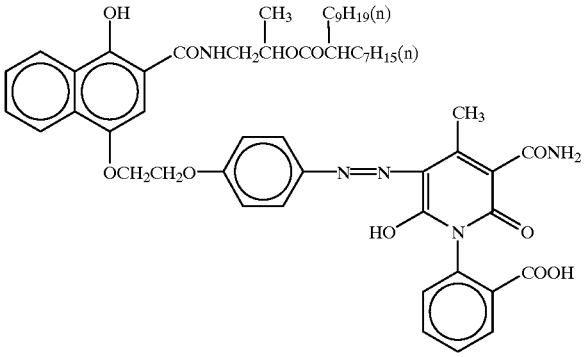

ExC-6

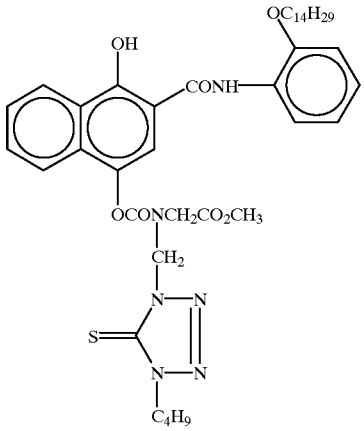

-continued
ExC-7
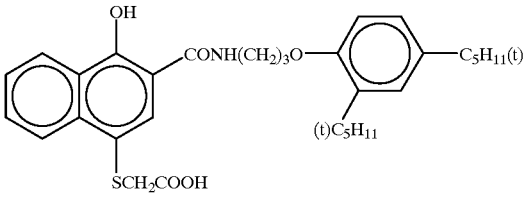
ExC-8
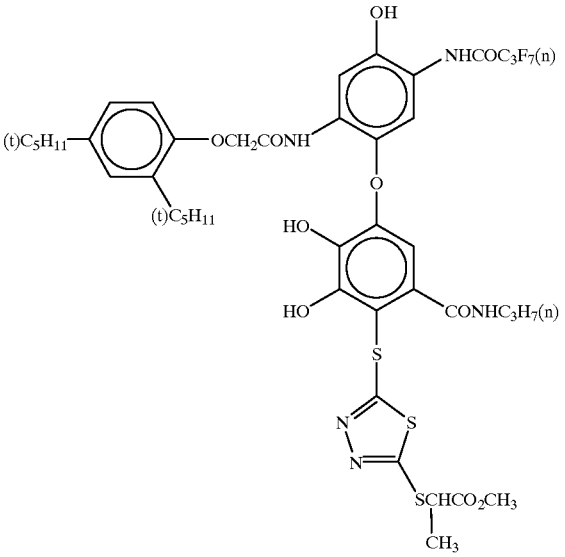
ExM-1
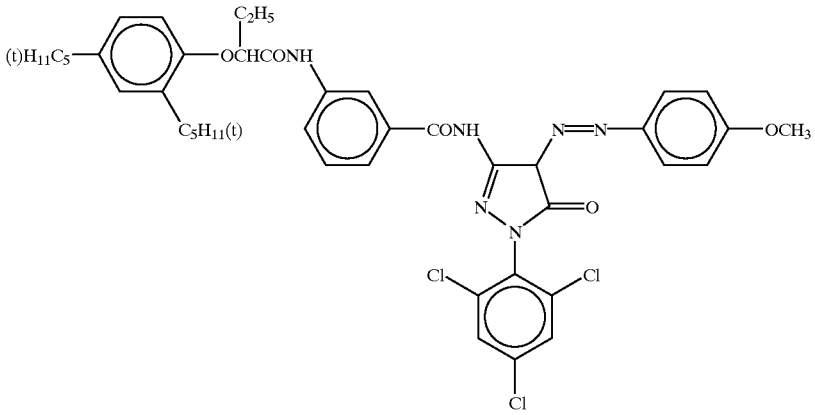
ExM-2
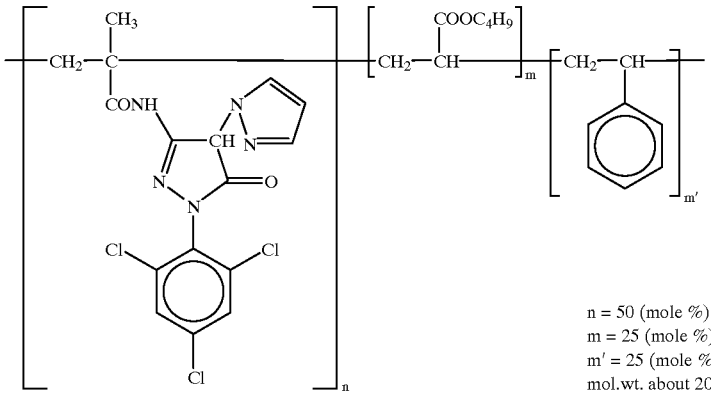
n = 50 (mole %)
m = 25 (mole %)
m′ = 25 (mole %)
mol.wt. about 20,000

-continued
ExM-3
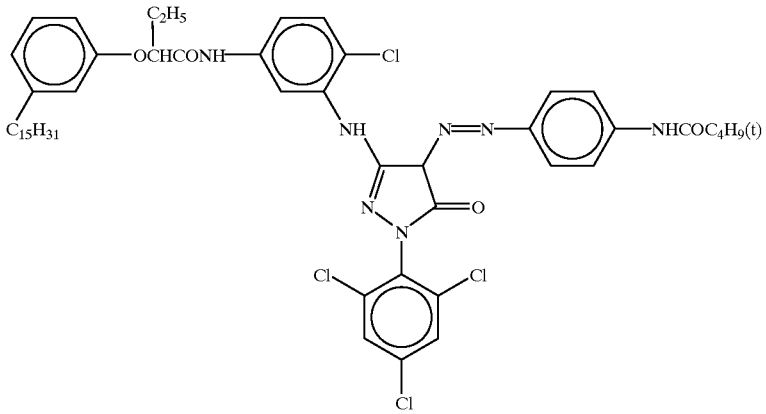
ExM-4
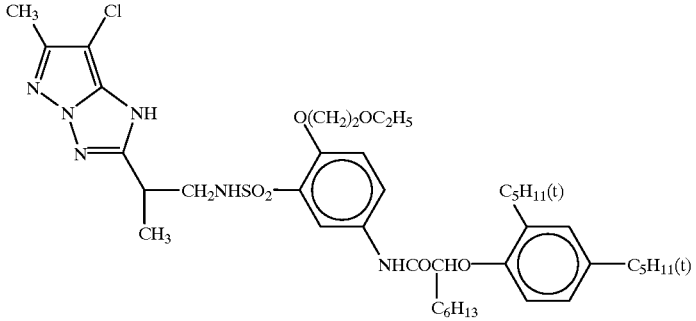
ExM-5
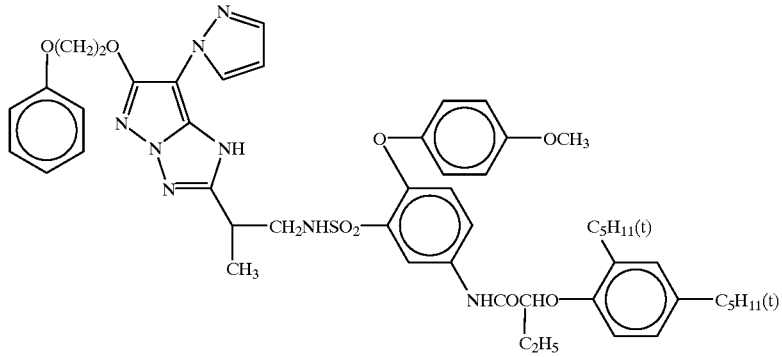
ExY-1
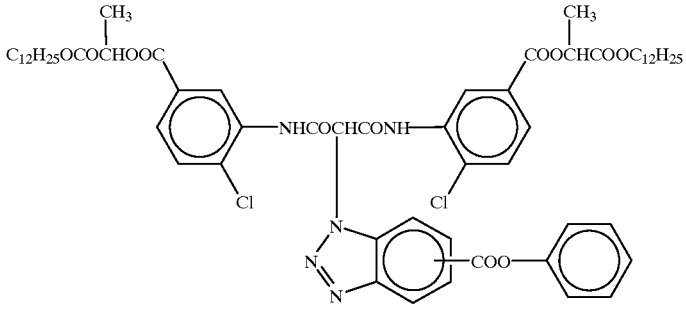

-continued
ExY-2
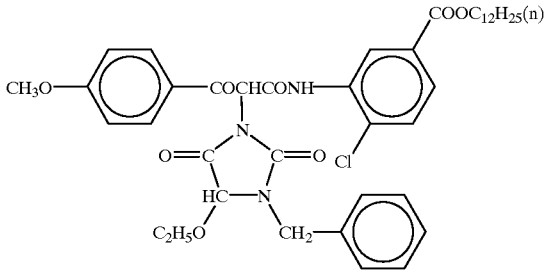
ExY-3
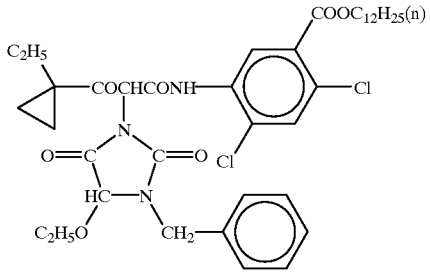
ExY-4
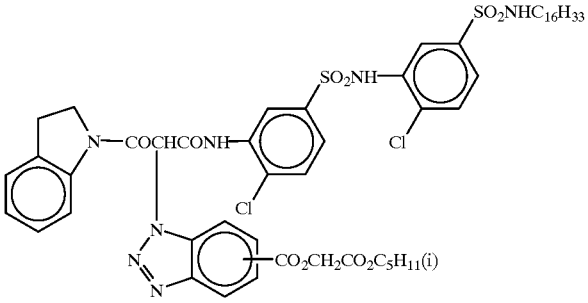
ExY-5
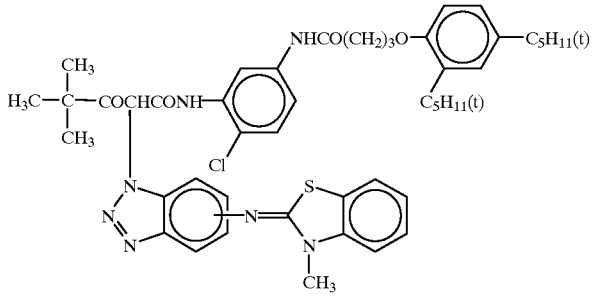
ExF-1
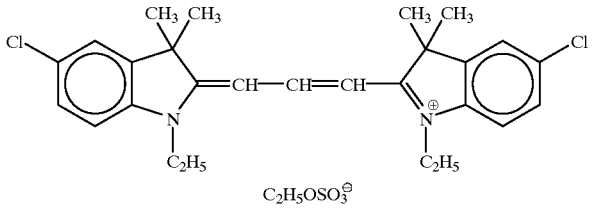
ExF-2
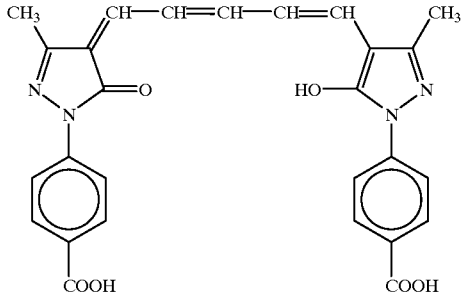
ExF-3
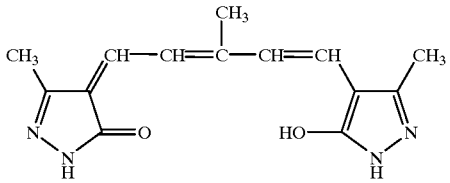
ExF-4
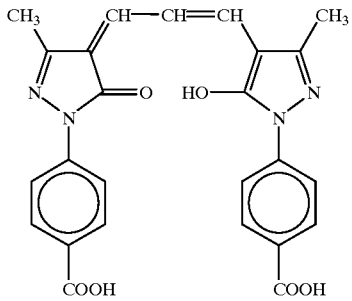

-continued
ExF-5
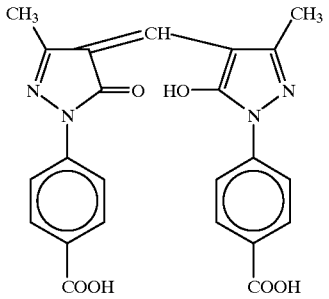
ExF-6
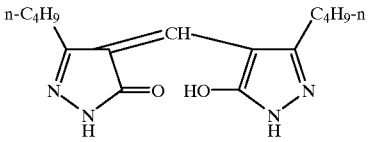
ExF-7
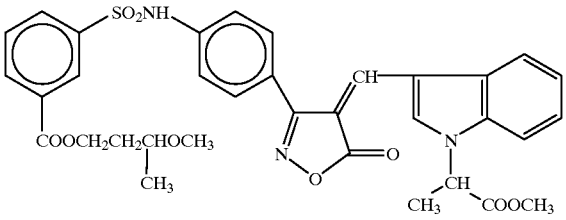
Cpd-1
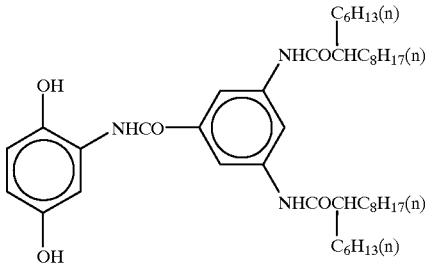
Cpd-2
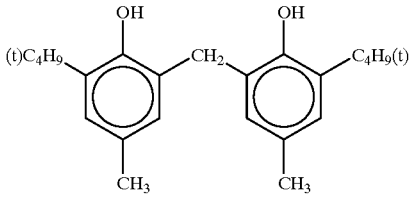
Cpd-3
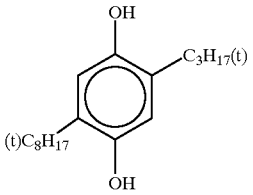
UV-1
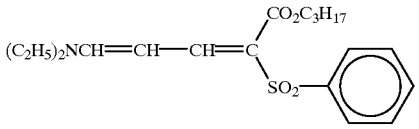
UV-2
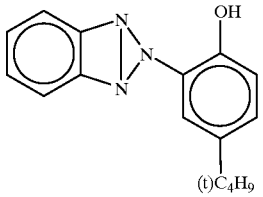
UV-3
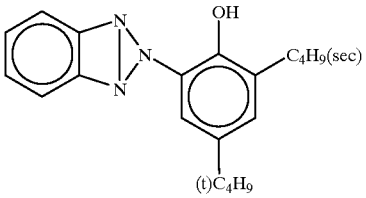
HBS-1
Tricresyl phosphate
HBS-2
Di-n-butyl phthalate
HBS-3
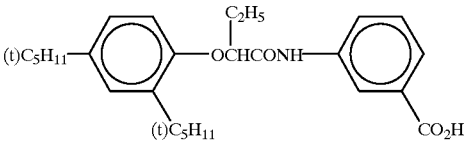
HBS-4
Tri(2-ethylhexyl)phosphate
ExS-1
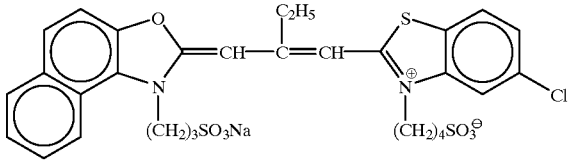

-continued
ExS-2
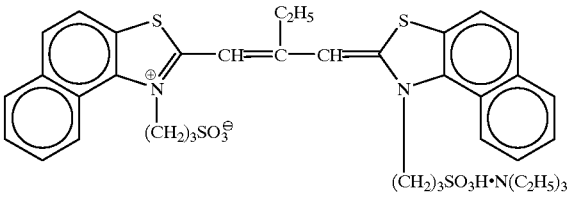
ExS-3
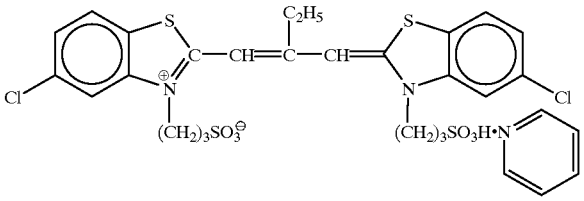
ExS-4
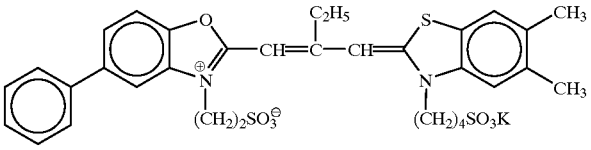
ExS-5
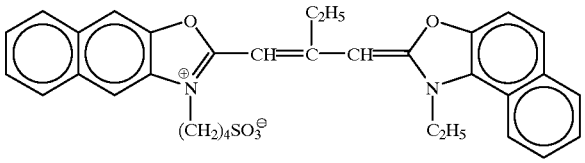
ExS-6
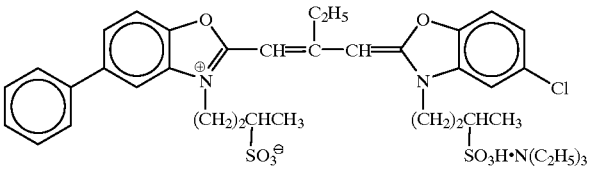
ExS-7
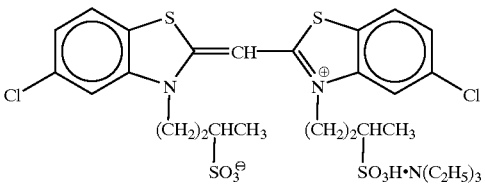
S-1
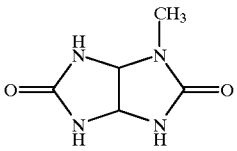
H-1
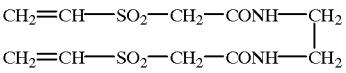
B-1
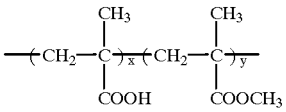
x/y = 10/90 (mole %)
B-2
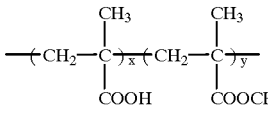
x/y = 40/60 (mole %)
B-3
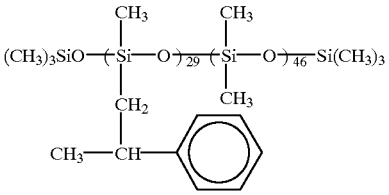
(mole %)
B-4
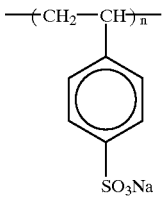
(n = an integer of ca. 1,000)
B-5
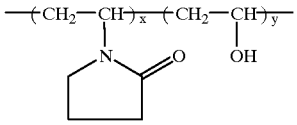
x/y = 70/30 (mole %)
B-6
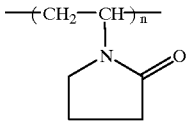
(mol. wt. about 10,000)
(n = an integer)
W-1
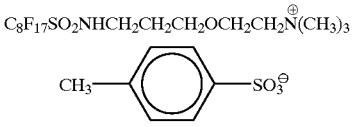
W-2
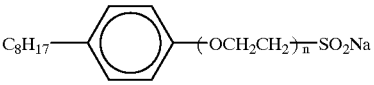
n = 2~4

-continued
W-3
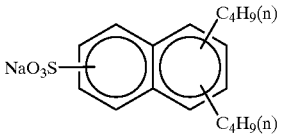
F-1
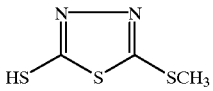
F-2
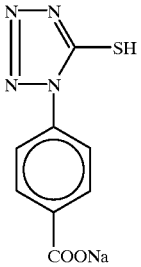
F-3
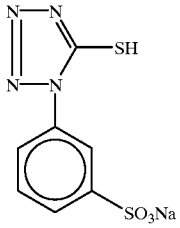
F-4
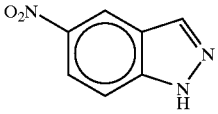
F-5
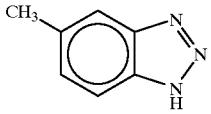
F-6
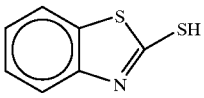
F-7
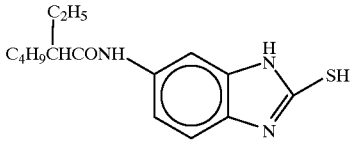
F-8
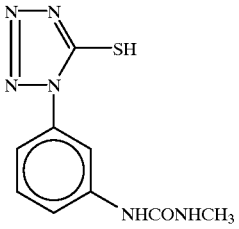
F-9
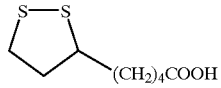
F-10
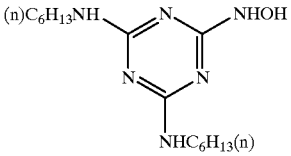
F-11
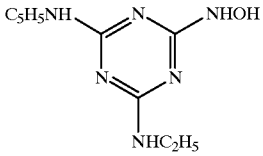
F-12
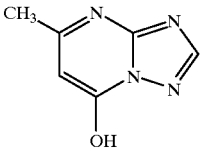
F-13
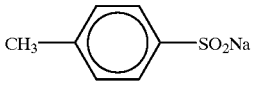
F-14
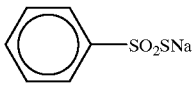
F-15
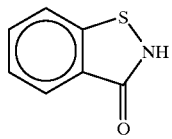
F-16
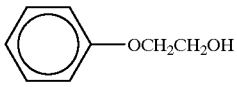
F-17
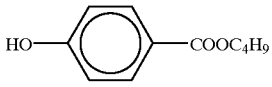

<Sample according to the Present Invention (Sample No. 102)>

A sample (Sample No. 102) according to the present invention having a reduced mask density as compared with that of Sample No. 101 was prepared in the same manner as Sample No. 101, except that the colored couplers ExC-2, ExC-5, ExM-1 and ExM-3 were not added.

<Another Sample According to the Present Invention (Sample No. 103)>

Another sample (Sample No. 103) having a reduced mask density and soft gradation according to the present invention was prepared under the same conditions as Sample No. 102, except that Emulsions shown in Table 2 were replaced by Emulsions shown in Table 3 respectively.

TABLE 3

| Emulsion | Average AgI content (%) | Variation coefficient (%) with respect to AgI contents among grains | Average diameter (equivalent-sphere diameter) (μm) | Variation coefficient (%) with respect to grain diameter | Projected area diameter (equivalent-circle diameter) (μm) | Diameter/thickness ratio |
|---|---|---|---|---|---|---|
| A | 2.0 | 15 | 0.47 | 20 | 0.50 | 3.0 |
| B | 3.7 | 20 | 0.50 | 20 | 0.70 | 3.6 |
| C | 8.9 | 30 | 0.66 | 25 | 0.77 | 4.5 |
| D | 9.0 | 25 | 0.79 | 30 | 0.80 | 3.0 |
| E | 2.0 | 15 | 0.47 | 20 | 0.50 | 3.0 |
| F | 4.0 | 20 | 0.50 | 20 | 0.70 | 3.6 |
| G | 9.0 | 27 | 0.63 | 27 | 0.65 | 4.0 |
| H | 9.0 | 27 | 0.63 | 27 | 0.65 | 4.0 |
| I | 9.0 | 25 | 0.79 | 29 | 0.80 | 3.0 |
| J | 2.0 | 15 | 0.47 | 20 | 0.50 | 3.7 |
| K | 8.9 | 22 | 0.80 | 27 | 0.80 | 4.2 |
| L | 14.0 | 27 | 1.30 | 30 | 1.40 | 3.0 |
| M | 1.0 | — | 0.07 | 15 | — | 1 |

The values of photographic characteristics (Dmin and gamma) obtained by processing the foregoing samples in accordance with the following standard processing formula for color negative films are shown below:

Values of Photographic Characteristics

| | Dmin | | | Gamma value | | |
|---|---|---|---|---|---|---|
| Sample No. | B | G | R | B | G | R |
| 101 | 0.90 | 0.58 | 0.24 | 0.90 | 0.68 | 0.68 |
| 102 | 0.25 | 0.21 | 0.21 | 0.90 | 0.68 | 0.68 |
| 103 | 0.25 | 0.20 | 0.20 | 0.45 | 0.42 | 0.40 |

2. Development Processing

The processing steps and the compositions of the processing solutions employed in the development processing for color negative film for examining the foregoing samples are illustrated below.

| Processing Step | Time | Temperature | Amount* replenished | Tank Volume |
|---|---|---|---|---|
| Color development | 3 min 5 sec | 38.0° C. | 20 ml | 17 l |
| Bleach | 30 sec | 38.0° C. | 5 ml | 5 l |
| Fixation (1) | 30 sec | 38.0° C. | — | 5 l |
| Fixation (2) | 30 sec | 38.0° C. | 8 ml | 5 l |
| Washing | 20 sec | 38.0° C. | 17 ml | 3.5 l |
| Stabilization (1) | 20 sec | 38.0° C. | — | 3 l |

-continued

| Processing Step | Time | Temperature | Amount* replenished | Tank Volume |
|---|---|---|---|---|
| Stabilization (2) | 20 sec | 38.0° C. | 15 ml | 3 l |
| Drying | 1 min 30 sec | 60° C. | | |

* per photographic material 35 mm by 1.1 m in dimensions (corresponding to a roll of 24 exposure film).

The stabilizing baths were replenished according to the counter current process, namely in the direction from (2) to (1), and all the overflow of washing water was introduced into the fixing bath (2). Also, the fix baths were connected by counter current pipe arrangement in the direction from (2) to (1). Additionally, the amount of the developer brought into the bleach step, the amount of the bleaching solution brought into the fixation step and the amount of the fixing solution brought into the washing step were 2.5 ml, 2.0 ml and 2.0 ml respectively per photographic material 35 mm by 1.1 m in dimensions. Every crossover time was 6 seconds, and it was included in the processing time of the previous step.

The composition of each processing solution is described below.

Color developer:

| | Tank Solution | Replenisher |
|---|---|---|
| Diethylenetriaminepentaacetic acid | 2.0 g | 2.0 g |
| 1-Hydroxyethylidene-1,1-diphosphonic acid | 2.0 g | 2.0 g |
| Sodium sulfite | 3.9 g | 5.3 g |
| Potassiuin carbonate | 37.5 g | 39.0 g |
| Potassium bromide | 1.4 g | 0.4 g |
| Potassium iodide | 1.3 mg | — |
| Disodium-N,N-bis(sulfonatoethyl) hydroxylainine | 2.0 g | 2.0 g |
| Hydroxylamine sulfate | 2.4 g | 3.3 g |
| 2-Methyl-4-[N-ethyl-N-(β-hydroxyethyl)amino]aniline sulfate | 4.5 g | 6.4 g |
| Water to make | 1.0 l | 1.0 l |
| pH (adjusted with KOH and $H_2SO_4$) | 10.05 | 10.18 |

Bleaching Bath:

| | Tank Solution | Replenisher |
|---|---|---|
| Ammonium 1,3-diaminopropanetetra-acetatoferrate (III) monohydrate | 118 g | 180 g |
| Ammonium bromide | 80 g | 115 g |
| Ammonium nitrate | 14 g | 21 g |
| Succinic acid | 40 g | 60 g |
| Maleic acid | 33 g | 50 g |
| Water to make | 1.0 l | 1.0 l |
| pH (adjusted with aqueous ammonia) | 4.4 | 4.0 |

Fixing Bath:

| | Tank Solution | Replenisher |
|---|---|---|
| Ammonium methanesulfinate | 10 g | 30 g |
| Ammonium methanethiosulfonate | 4 g | 12 g |
| Ammonium thiosulfate (700 g/l) | 280 ml | 840 ml |
| Imidazole | 7 g | 20 g |
| Ethylenediaminetetraacetic acid | 15 g | 45 g |
| Water to make | 1.0 l | 1.0 l |
| pH (adjusted with aq. ammonia and acetic acid) | 7.4 | 7.45 |

Washing Bath

City water was passed through a mixed-bed column packed with an H-type strong acidic cation exchange resin (Amberlite IR-120B, produced by Rohm & Haas Co.) and an OH-type strong basic anion exchange resin (Amberlite IR-400, produced by Rohm & Hass Co.) to reduce calcium and magnesium ion concentrations each to 3 mg/l or below, and then admixed with 20 mg/l of sodium dichloroisocyanurate and 150 mg/l of sodium sulfate. The pH of the resulting water was in the range of 6.5 to 7.5.

Stabilizing Bath (common to tank solution and replenisher):

| | |
|---|---|
| Sodium p-toluenesulfinate | 0.03 g |
| Polyoxyethylene-p-monononylphenylether (average polymerization degree: 10) | 0.2 g |
| Disodium ethylenediaminetetracetate | 0.05 g |
| 1,2,4-Triazole | 1.3 g |
| 1,4-Bis(1,2,4-triazole-1-ylmethyl)piperazine | 0.75 g |
| 1,2-Benzisothiazoline-3-one | 0.10 g |
| Water to make | 1.0 l |
| pH adjusted to | 8.5 |

3. Picture Processing and Output Device

In performing the picture processing, which comprises taking in the images formed by the foregoing development processing and converting the input images into electric image signals, by means of a FP560B-remodelled development processing machine (made by Fuji Photo Film Co., Ltd.), a commercial model of high-speed scanner/image work station, SP-1000 (made by Fuji Photo Film Co., Ltd.), was used. And the production of color prints from the electric image signals put out of the processing machine was carried out with a commercially available printer, a laser printer/paper processor LP-1000P (made by Fuji Photo Film Co., Ltd.).

The color paper used in each examination was commercial color paper, Fiji Color Paper Super FA5 (a product of Fuji Photo Film Co., Ltd.), and the development processing thereof was carried out in accordance with a general all-purpose formula, CP47L (the development processing formula and processing agents for color paper, made by Fuji Photo Film Co., Ltd.).

4. Examination Results

Two thousands rolls of color negative film Sample No. 101, which were each 1.1 m long by 35 mm wide, were exposed imagewise, and subjected to 20 days' continuous processing so that the processing conditions were in running equilibrium. Thereafter, the photographs of an object including Macbeth chart were taken using each of the color negative films, Sample Nos. 101, 102 and 103. The picture-taking was carried out under exposure conditions changed stepwise from under-exposure to overexposure by using four different stops, namely the stops of minus 3 (3 under), standard, plus 3 (3 over) and plus 6.

The print on the foregoing commercial color paper, Fuji Color Paper Super FA5 (a product of Fuji Photo Film Co., Ltd.) which was obtained by subjecting each of the samples having undergone the foregoing exposure and development processing to the aforementioned processing operations using the high-speed scanner/image work station SP-1000 (made by Fuji Photo Film Co., Ltd.) and the laser printer/paper processor LP-1000P (made by Fuji Photo Film Co., Ltd.) was examined for white ground density and maximum density (herein, the Dmin and Dmax of a print are referred to as ground density and maximum density respectively in order to avoid confusion with Dmax and Dmin of a negative film). The examination results obtained are shown in Table 4. The data set forth in Table 4 are relative values expressed in terms of the differences from the corresponding values of the print obtained in the case of adopting the standard exposure condition (symbolized by "N" in Table 4).

TABLE 4

| Sample | | −3 | | | N | | | +3 | | | +6 | | |
|---|---|---|---|---|---|---|---|---|---|---|---|---|---|
| No. | | B | G | R | B | G | R | B | G | R | B | G | R |
| 101 | White ground density | 0 | 0 | 0 | 0 | 0 | 0 | +0.03 | +0.03 | +0.03 | +0.06 | +0.07 | +0.07 |
| | Maximum density | 0 | 0 | 0 | 0 | 0 | 0 | −0.10 | −0.08 | −0.08 | −0.25 | −0.28 | −0.20 |
| 102 | White ground density | 0 | 0 | 0 | 0 | 0 | 0 | +0.01 | +0.01 | −0.01 | +0.02 | +0.02 | +0.02 |
| | Maximum density | 0 | 0 | 0 | 0 | 0 | 0 | −0.03 | −0.02 | −0.02 | −0.03 | −0.03 | −0.04 |
| 103 | White ground density | 0 | 0 | 0 | 0 | 0 | 0 | 0 | 0 | 0 | +0.01 | +0.01 | +0.01 |
| | Maximum density | 0 | 0 | 0 | 0 | 0 | 0 | 0 | 0 | 0 | 0 | −0.01 | 0 |

As can be seen from Table 4, each of Sample Nos. 102 and 103 prepared in accordance with the present invention provided prints having small differences between the standard exposure condition and other exposure conditions with respect to both white ground density and maximum density. In other words, the above data demonstrate that the present samples were hard to be affected by picture-taking conditions even when these conditions were deviated from the standard ones; as a result, they can steadily provide prints of excellent quality. In particular, Sample No. 103 having reduced Dmin and soft gradation has proved to be greater in the effects aimed at by the present invention. On the other hand, the comparative sample, Sample No. 101, having Dmin and gradation (gamma value) equivalent to those of a commercial all-purpose color negative film was shown to be not relieved by the picture processing in the overexposure cases to cause appreciable increases of white ground densities and considerable decreases of maximum densities in the prints.

By reading the images formed by subjecting a color negative film constituted so as to provide a density of 0.5 or below in the non-image area to successive exposure and development processing operations, converting the read images into optical or electric digital image signals, subjecting the digital image signals to picture processing and then reproducing the processed image signals on a positive material, the accuracy of image reading can be secured and the influences of picture-taking under overexposure conditions can be reduced to steadily reproduce positive images of excellent quality.

In addition, greater effects as regards the above-described points can be achieved by the use of a color negative film constituted so as to have not only a reduced Dmin but also soft gradation.

While the invention has been described in detail and with reference to specific embodiments thereof, it will be apparent to one skilled in the art that various changes and modifications can be made therein without departing from the spirit and scope thereof.

What is claimed is:

1. A method of forming color images, which comprises subjecting an exposed color photographic material to development processing to obtain image information, and transmitting the image information to a printer; wherein (1) said color photographic material providing an optical density of from 0.1 to 0.2 in the non-image area after the development processing in each of densitometric measurements using red light, green light and blue light, respectively, and (2)(a) the image information recorded in said color photographic material being read photoelectrically, (b) the read image information being converted into electric digital image information, (c) the converted image information being subjected to picture processing and then (d) the processed image information being transmitted to a printer.

2. The method of forming color images according to claim 1, wherein said color photographic material has a gradient between 0.20 and 0.60 after the development processing.

3. The method of forming color images according to claim 2, wherein the printer is loaded with silver salt color photographic paper.

4. The method of forming color images according to claim 3, wherein the development processing is a rapid processing and requires 30 to 210 seconds for covering the period from the completion of the color developing step to the beginning of the drying step via desilvering, washing and image stabilization steps.

5. The method of forming color images according to claim 2, wherein the development processing is a rapid processing and requires 30 to 210 seconds for covering the period from the completion of the color developing step to the beginning of the drying step via desilvering, washing and image stabilization steps.

6. The method of forming color images according to claim 1, wherein said printer is loaded with silver salt color photographic paper.

7. The method of forming color images according to claim 6, wherein the development processing is a rapid processing and requires 30 to 210 seconds for covering the period from the completion of the color developing step to the beginning of the drying step via desilvering, washing and image stabilization steps.

8. The method of forming color images according to claim 1, wherein said development processing is a rapid processing and requires 30 to 210 seconds for covering the period from the completion of the color developing step to the beginning of the drying step via desilvering, washing and image stabilization steps.

9. A picture-taking color photographic material used in a method of forming color images wherein an exposed color photographic material is subjected to development processing and the image information thus recorded therein is read photoelectrically, the read image information is converted into electric digital image information, the converted image information is subjected to picture processing and then the processed image information is transmitted to a printer; said color photographic material providing an optical density of from 0.1 to 0.2 in the non-image area in each of densitometric measurements using red light, green light and blue light respectively and having a gradient between 0.20 and 0.60 in image areas after the development processing.

* * * * *